US009218817B2

(12) United States Patent
Ragot et al.

(10) Patent No.: US 9,218,817 B2
(45) Date of Patent: Dec. 22, 2015

(54) LOW-DELAY SOUND-ENCODING ALTERNATING BETWEEN PREDICTIVE ENCODING AND TRANSFORM ENCODING

(75) Inventors: Stéphane Ragot, Lannion (FR); Balazs Kovesi, Lannion (FR); Pierre Berthet, Noyal-Châtillon-sur-Seiche (FR)

(73) Assignee: FRANCE TELECOM, Paris (FR)

( * ) Notice: Subject to any disclaimer, the term of this patent is extended or adjusted under 35 U.S.C. 154(b) by 248 days.

(21) Appl. No.: 13/997,446

(22) PCT Filed: Dec. 20, 2011

(86) PCT No.: PCT/FR2011/053097

§ 371 (c)(1), (2), (4) Date: Jun. 24, 2013

(87) PCT Pub. No.: WO2012/085451

PCT Pub. Date: Jun. 28, 2012

(65) Prior Publication Data

US 2013/0289981 A1 Oct. 31, 2013

(30) Foreign Application Priority Data

Dec. 23, 2010 (FR) ..... 10 61203

(51) Int. Cl.
*G10L 19/04* (2013.01)
*G10L 19/12* (2013.01)
(Continued)

(52) U.S. Cl.
CPC ..... *G10L 19/12* (2013.01); *G10L 19/022* (2013.01); *G10L 19/18* (2013.01); *G10L 19/0212* (2013.01); *G10L 19/04* (2013.01)

(58) Field of Classification Search
CPC ..... G10L 19/04; G10L 19/00; G10L 19/167; G10L 19/20; G10L 19/22; G10L 19/24; H03G 3/00
USPC ..... 704/200–504; 370/240.14–240.16, 370/240.25, 240.12, 240.1, 240.04
See application file for complete search history.

(56) References Cited

U.S. PATENT DOCUMENTS 5,752,222 A * 5/1998 Nishiguchi et al. ..... 704/201
5,787,387 A * 7/1998 Aguilar ..... 704/208
(Continued)

FOREIGN PATENT DOCUMENTS

FR 2936898 A1 9/2010

OTHER PUBLICATIONS

International Search Report and Written Opinion dated Mar. 6, 2012 for corresponding International Application No. PCT/FR2011/053097, filed Dec. 20, 2011.
(Continued)

*Primary Examiner* — Vijay B Chawan
(74) *Attorney, Agent, or Firm* — David D. Brush; Westman, Champlin & Koehler, P.A.

(57) ABSTRACT

An encoder and a method for encoding a digital signal are provided. The method includes encoding a preceding frame of samples of the digital signal according to a predictive encoding process, and encoding a current frame of samples of the digital signal according to a transform encoding process. The method is implemented such that a first portion of the current frame is also encoded by predictive encoding that is limited relative to the predictive encoding of the preceding frame by reusing at least one parameter of the predictive encoding of the preceding frame and only encoding the parameters of said first portion of the current frame that are not reused. A decoder and a decoding method are also provided, which correspond to the described encoding method.

16 Claims, 11 Drawing Sheets

(51) Int. Cl.

| | |
|---|---|
| ***G10L 19/022*** | (2013.01) |
| ***G10L 19/18*** | (2013.01) |
| *G10L 19/02* | (2013.01) |

(56) References Cited

U.S. PATENT DOCUMENTS

| | | | | |
|---|---|---|---|---|
| 6,134,518 | A * | 10/2000 | Cohen et al. | 704/201 |
| 7,171,355 | B1 * | 1/2007 | Chen | 704/226 |
| 7,496,506 | B2 * | 2/2009 | Chen | 704/226 |
| 8,751,246 | B2 * | 6/2014 | Lecomte et al. | 704/501 |
| 2002/0069052 | A1 * | 6/2002 | Chen | 704/230 |
| 2002/0072904 | A1 * | 6/2002 | Chen | 704/230 |
| 2007/0124139 | A1 * | 5/2007 | Chen | 704/219 |
| 2007/0136052 | A1 * | 6/2007 | Gao et al. | 704/207 |
| 2009/0043574 | A1 * | 2/2009 | Gao et al. | 704/223 |
| 2011/0178809 | A1 | 7/2011 | Philippe et al. | |

OTHER PUBLICATIONS

Neuendorf M. et al., "Completion of Core Experiment on Unification of USAC Windowing and Frame Transitions" 91. MPEG Meeting; Kyoto; (Motion Picture Expert Group or ISO/IEC JTC1/SC29/WG11),, Jan. 16, 2010, XP030045757, p. 1, line 1-10, p. 5, line 1, paragraph 4.3, figures 7.8.

Lecomte J. et al., "Efficient Cross-Fade Windows for Transmissions Between LPC-Based and Non-LPC Based Audio Coding" AES Convention 126; May 2009, AES, 60 East 42nd Street, Room 2520 New York 10165-2520, USA, May 1, 2009, XP040508994.

International Preliminary Report on Patentability and English translation of the Written Opinion dated Jun. 25, 2013 for corresponding International Application No. PCT/FR2011/053097, filed Dec. 20, 2011.

* cited by examiner

LOW-DELAY SOUND-ENCODING ALTERNATING BETWEEN PREDICTIVE ENCODING AND TRANSFORM ENCODING

CROSS-REFERENCE TO RELATED APPLICATIONS

This application is a Section 371 National Stage Application of International Application No. PCT/FR2011/053097, filed Dec. 20, 2011, which is incorporated by reference in its entirety and published as WO 2012/085451 on Jun. 28, 2012, not in English.

STATEMENT REGARDING FEDERALLY SPONSORED RESEARCH OR DEVELOPMENT

None.

THE NAMES OF PARTIES TO A JOINT RESEARCH AGREEMENT

None.

FIELD OF THE DISCLOSURE

The present invention relates to the field of coding of digital signals.

Advantageously, the invention applies to the coding of sounds having alternating speech and music.

BACKGROUND OF THE DISCLOSURE

In order to effectively code speech sounds, CELP (Code Excited Linear Prediction) type techniques are recommended. In order to effectively code musical sounds, transform coding techniques are recommended in preference.

Encoders of the CELP type are predictive encoders. Their purpose is to model the production of speech based on various elements: a short-term linear prediction for modeling the vocal tract, a long-term prediction for modeling the vibration of the vocal chords in the voiced period, and an excitation derived from a fixed dictionary (white noise, algebraic excitation) in order to represent the "innovation" that has not been able to be modeled.

The transform encoders that are most widely used (the MPEG AAC or ITU-T G.722.1 Annex C encoder for example) use critical sampling transforms in order to compact the signal in the transform domain. "Critical sampling transform" is a transform for which the number of coefficients in the transform domain is equal to the number of temporal samples analyzed.

One solution for effectively coding a signal containing these two types of content consists in selecting the best technique over time. This solution has been notably recommended by the 3GPP (3rd Generation Partnership Project) standardization organization, and a technique called AMR WB+ has been proposed.

This technique is based on a CELP technology of the AMR-WB type, more specifically of the ACELP (for "Algebraic Code Excited Linear Prediction") type, and transform coding based on an overlap Fourier transform in a model of the TCX (for "Transform Coded eXcitation") type.

The ACELP coding and the TCX coding are both techniques of predictive linear type. It should be noted that the AMR-WB+ codec has been developed for the 3GPP PSS (for "Packet Switched Streaming"), MBMS (for "Multimedia Broadcast/Multicast Service") and MMS (for "Multimedia Messaging Service") services, in other words for broadcasting and storage services with no strong constraints on the algorithmic delay.

This solution suffers from insufficient quality on the music. This insufficiency comes particularly from the transform coding. In particular, the overlap Fourier transform is not a critical sampling transformation, and therefore it is suboptimal.

Moreover, the windows used in this encoder are not optimal with respect to the concentration of energy: the frequency shapes of these virtually rectangular windows are suboptimal.

An improvement of the AMR-WB+ coding combined with the principles of MPEG AAC (for "Advanced Audio Coding") coding is given by the MPEG USAC (for "Unified Speech Audio Coding") codec which is still being developed at the ISO/MPEG. The applications targeted by MPEG USAC are not conversational, but correspond to broadcasting and storage services with no strong constraints on the algorithmic delay.

The initial version of the USAC codec, called RM0 (Reference Model 0), is described in the article by M. Neuendorf et al., A Novel Scheme for Low Bitrate Unified Speech and Audio Coding—MPEG RM0, 7-10 May 2009, 126th AES Convention. This RM0 codec alternates between several coding modes:

- For the signals of the speech type: LPD (for "Linear Predictive Domain") modes comprising two different modes derived from AMR-WB+ coding:
  - An ACELP mode
  - A TCX mode called wLPT (for "weighted Linear Predictive Transform") using a transform of the MDCT type (unlike the AMR-WB+ codec).
- For the signals of the music type: FD (for "Frequency Domain") mode using MDCT (for "Modified Discrete Cosine Transform") transform coding of the MPEG AAC (for "Advanced Audio Coding") type on 1024 samples.

Compared with the AMR-WB+ codec, the various majors provided by the USAC RM0 coding for the mono part are the use of a critical decimation transform of the MDCT type for the transform coding and the quantization of the MDCT spectrum by scalar quantization with arithmetic coding. It should be noted that the acoustic band coded by the various modes (LPD, FD) depends on the selected mode, which is not the case in the AMR-WB+ codec where the ACELP and TCX modes operate at the same internal sampling frequency. Moreover, the decision concerning mode in the USAC RM0 codec is carried out in an open loop for each frame of 1024 samples. Note that a closed-loop decision is made by executing the various coding modes in parallel and by choosing a posteriori the mode that gives the best result according to a predefined criterion. In the case of an open-loop decision, the decision is taken a priori as a function of the data and of the observations available but without testing whether this decision is optimal or not.

In the USAC codec, the transitions between LPD and FD modes are crucial for ensuring sufficient quality without failure of switching, knowing that each mode (ACELP, TCX, FD) has a specific "signature" (in terms of artifacts) and that the FD and LPD modes are of different kinds—the FD mode is based on transform coding in the domain of the signal, while the LPD modes use predictive linear coding in the field that is perceptually weighted with filter memories to be managed correctly. The management of intermode switchings in the USAC RM0 codec is explained in detail in the article by J. Lecomte et al., "Efficient cross-fade windows for transitions between LPC-based and non-LPC based audio coding", 7-10 May 2009, 126th AES Convention. As explained in this article, the main difficulty lies in the transitions between LPD to FD modes and vice-versa. All that is retained here is the case of the transitions from ACELP to FD.

In order to fully understand the operation, here is a recap on the principle of MDCT transform coding through a typical exemplary embodiment.

At the encoder, the MDCT transformation is divided between three steps:

Weighting of the signal by a window called in this instance the "MDCT window" with a length of 2M Time-domain aliasing in order to form a block of length M DCT (for "Discrete Cosine Transform") transformation of length M.

The MDCT window is divided into 4 adjacent portions of equal length M/2, called "quarts".

The signal is multiplied by the analysis window and then the aliasings are carried out: the first quart (windowed) is aliased (that is to say inverted in time and made to overlap) on the second quart and the fourth quart is aliased on the third.

More precisely, the aliasing of one quart on another is carried out in the following manner: the first sample of the first quart is added to (or subtracted from) the last sample of the second quart, the second sample of the first quart is added to (or subtracted from) the penultimate sample of the second quart, and so on to the last sample of the first quart which is added to (or subtracted from) the first sample of the second quart.

This therefore gives, on the basis of 4 quarts, 2 aliased quarts in which each sample is the result of a linear combination of 2 samples of the signal to be coded. This linear combination is called time-domain aliasing.

These 2 aliased quarts are then coded jointly after DCT transformation. For the following frame, there is a half-offset of a window (50% of overlap), the third and fourth quarts of the preceding frame then become the first and second quarts of the current frame. After aliasing, a second linear combination of the same pairs of samples is sent as in the preceding frame, but with different weights.

At the decoder, after inverse DCT transformation, the decoded version of these aliased signals is then obtained. Two consecutive frames contain the result of 2 different aliasings of the same quarts, that is to say for each pair of samples there is the result of 2 linear combinations with different but known weights: an equation system is therefore resolved in order to obtain the decoded version of the input signal; the time-domain aliasing can therefore be removed by using 2 consecutive decoded frames.

The resolution of the equation systems mentioned is usually carried out by anti-aliasing, multiplication by a carefully chosen synthesis window and then addition-overlapping of the common parts. This addition-overlapping at the same time provides the soft transition (without discontinuity due to the quantization errors) between 2 consecutive decoded frames; specifically this operation behaves like a cross-fade. When the window for the first quart or the fourth quart is at zero for each sample, it is called an MDCT transformation without time-domain aliasing in this part of the window. In this case, the soft transition is not ensured by the MDCT transformation; it must be carried out by other means such as for example an external cross-fade.

It should be noted that variant embodiments of the MDCT transformation exist, in particular on the definition of the DCT transform, on how to time-domain aliase the block to be transformed (for example, it is possible to invert the signs applied to the aliased quarts to the left and the right, or to aliase the second and third quarts on respectively the first and fourth quarts), etc. These variants do not change the principle of the MDCT synthesis-analysis with the reduction of the block of samples by windowing, time-domain aliasing and then transformation and finally windowing, aliasing and addition-overlapping.

In the case of the USAC RM0 encoder described in the article by Lecomte et al., the transition between a frame coded by ACELP coding and a frame coded by FD coding takes place in the following manner:

A transition window for the FD mode is used with an overlap to the left of 128 samples, as illustrated in FIG. 1. The time-domain aliasing on this overlap zone is canceled out by introducing an "artificial" time-domain aliasing on the right of the reconstructed ACELP frame. The MDCT window used for the transition has a size of 2304 samples and the DCT transformation operates on 1152 samples while normally the frames of the FD mode are coded with a window with a size of 2048 samples and a DCT transformation of 1024 samples. Thus the MDCT transformation of the normal FD mode cannot be directly used for the transition window; the encoder must also incorporate a modified version of this transformation which complicates the implementation of the transition for the FD mode.

These coding techniques of the prior art, AMR-WB+ or USAC, have algorithmic delays of the order of 100 to 200 ms. These delays are incompatible with conversational applications for which the coding delay is usually of the order of 20-25 ms for the speech encoders for mobile applications (e.g.: GSM EFR, 3GPP AMR and AMR-WB) and of the order of 40 ms for the conversational transform encoders for videoconference (e.g.: ITU-T G.722.1 Annex C and G.719).

There is therefore a need for coding that alternates the techniques of predictive and transform coding for applications of coding sounds having alternating speech and music with a good coding quality at the same time of the speech and of the music and an algorithmic delay that is compatible with conversational applications, typically of the order of 20 to 40 ms for frames of 20 ms.

SUMMARY

An embodiment of the present invention proposes a method for coding a digital sound signal, comprising the steps of:

coding of a preceding frame of samples of the digital signal according to predictive coding;

coding of a current frame of samples of the digital signal according to transform coding.

The method is such that a first part of the current frame is coded by predictive coding that is restricted relative to the predictive coding of the preceding frame by reusing at least one parameter of the predictive coding of the preceding frame and by coding only the unreused parameters of this first part of the current frame.

Therefore, for coding that alternates codings of the predictive type and transform codings, during the passage of a frame coded according to predictive coding and a frame coded according to transform coding, a transition frame is thus provided. The fact that the first part of the current frame is also coded by predictive coding makes it possible to recover aliasing terms that it would not be possible to recover only by transform coding since the memory of transform coding for this transition frame is not available, the preceding frame not having been transform-coded.

In addition, the fact of using restricted predictive coding makes it possible to limit the impact on the coding bit rate of this part. Specifically, only the parameters that are not reused of the preceding frame are coded for the part of the current frame coded by restricted predictive coding.

Moreover, the coding of this frame part does not induce any additional delay since this first part is situated at the beginning of the transition frame.

Finally, this type of coding makes it possible to remain with a weighting window size of identical length for transform coding whether for the coding of the transition frame or for the coding of the other, transform-coded frames. The complexity of the coding method is thereby reduced.

The various particular embodiments mentioned below can be added independently or in combination with one another to the steps of the method defined above.

In one particular embodiment, the restricted predictive coding uses a prediction filter copied from the preceding frame of predictive coding.

The use of transform coding is usually selected when the coded segments are virtually stationary. Thus, the spectral-envelope parameter of the signal can be reused from one frame to another for a duration of a part of the frame, for example a subframe, without it having a considerable impact on the coding quality. The use of the prediction filter used for the preceding frame does not therefore impact the coding quality and makes it possible to dispense with additional bits for the transmission of its parameters.

In a variant embodiment, the restricted predictive coding also uses a decoded value of the pitch and/or of its associated gain of the preceding frame of predictive coding.

These parameters do not change much from one frame to another. The use of these same parameters from one frame to another will have little impact on the coding quality and will all the more simplify the predictive coding of the subframe.

In another variant embodiment, certain parameters of predictive coding used for the restricted predictive coding are quantized in differential mode relative to decoded parameters of the preceding frame of predictive coding.

Thus, this makes it possible to further simplify the predictive coding of the transition subframe.

According to one particular embodiment, the method comprises a step of obtaining the reconstructed signals originating from the predictive and transform local codings and decodings of the first subframe of the current frame and of combining by a cross-fade of these reconstructed signals.

Thus, the coding transition in the current frame is soft and does not induce awkward artifacts.

According to one particular embodiment, said cross-fade of the reconstructed signals is carried out on a portion of the first part of the current frame as a function of the shape of the weighting window of the transform coding.

This results in a better adaptation of the transform coding.

According to one particular embodiment, said cross-fade of the reconstructed signals is carried out on a portion of the first part of the current frame, said portion containing no time-domain aliasing.

This makes it possible to carry out a perfect reconstruction of the signals in the absence of quantization error, in the case in which the reconstructed signal originating from the transform coding of the first part of the current frame does not comprise any time-domain aliasing.

In one particular embodiment, for coding with low delay, the transform coding uses a weighting window comprising a chosen number of successive weighting coefficients of zero value at the end and beginning of the window.

In another particular embodiment, in order to improve the low-delay coding, the transform coding uses an asymmetric weighting window comprising a chosen number of successive weighting coefficients of zero value at at least one end of the window.

The present invention also relates to a method for decoding a digital sound signal, comprising the steps of:

- predictive decoding of a preceding frame of samples of the digital signal received and coded according to predictive coding;
- inverse transform decoding of a current frame of samples of the digital signal received and coded according to transform coding;
- the method is such that it also comprises a step of decoding by restricted predictive decoding relative to the predictive decoding of the preceding frame of a first part of the current frame.

The decoding method is the counterpart of the coding method and provides the same advantages as those described for the coding method.

Thus, in one particular embodiment, the decoding method comprises a step of combining by a cross-fade of the signals decoded by inverse transform and by restricted predictive decoding for at least one portion of the first part of the current frame received and coded according to restricted predictive coding, by reusing at least one parameter of the predictive decoding of the preceding frame and by decoding only the parameters received for this first part of the current frame.

According to a preferred embodiment, the restricted predictive decoding uses a prediction filter decoded and used by the predictive decoding of the preceding frame.

In a variant embodiment, the restricted predictive decoding also uses a decoded value of the pitch and/or of its associated gain of the predictive decoding of the preceding frame.

The present invention also relates to a digital sound signal encoder, comprising:

- a predictive coding module for coding a preceding frame of samples of the digital signal;
- a transform coding module for coding a current frame of samples of the digital signal. The encoder also comprises a predictive coding module that is restricted relative to the predictive coding of the preceding frame in order to code a first part of the current frame, by reusing at least one parameter of the predictive coding of the preceding frame and by coding only the unreused parameters of this first part of the current frame.

Similarly, the invention relates to a digital sound signal decoder, comprising:

- a predictive decoding module for decoding a preceding frame of samples of the digital signal received and coded according to predictive coding;
- an inverse transform decoding module for decoding a current frame of samples of the digital signal received and coded according to transform coding. The decoder is such that it also comprises a predictive decoding module that is restricted relative to the predictive decoding of the preceding frame in order to decode a first part of the current frame received and coded according to restricted predictive coding, by reusing at least one parameter of the predictive decoding of the preceding frame and by decoding only the parameters received for this first part of the current frame.

Finally, the invention relates to a computer program comprising code instructions for the implementation of the steps of the coding method as described above and/or of the decoding method as described above, when these instructions are executed by a processor.

The invention also relates to a storage means, that can be read by a processor, which may or may not be incorporated into the encoder or the decoder, optionally being removable, storing a computer program implementing a coding method and/or a decoding method as described above.

BRIEF DESCRIPTION OF THE DRAWINGS

Other features and advantages of the invention will become evident on examination of the following detailed description and of the appended figures amongst which.

DETAILED DESCRIPTION OF ILLUSTRATIVE EMBODIMENTS

Figure 1:
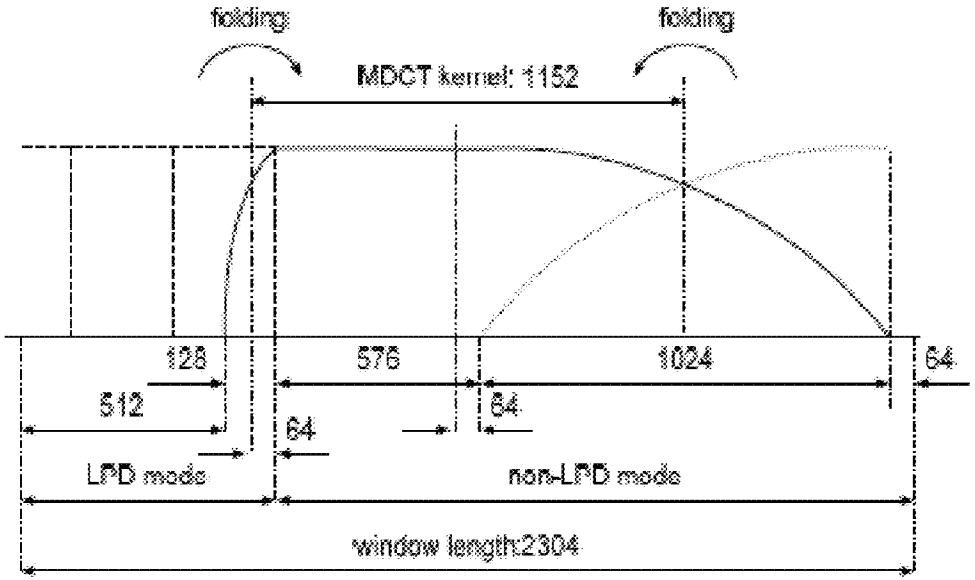
Fig.1 (Prior Art)
FIG. 1 illustrates an example of a transition window of the prior art for the transition between CELP coding and FD coding of the MPEG USAC codec, described above.
Figure 2:
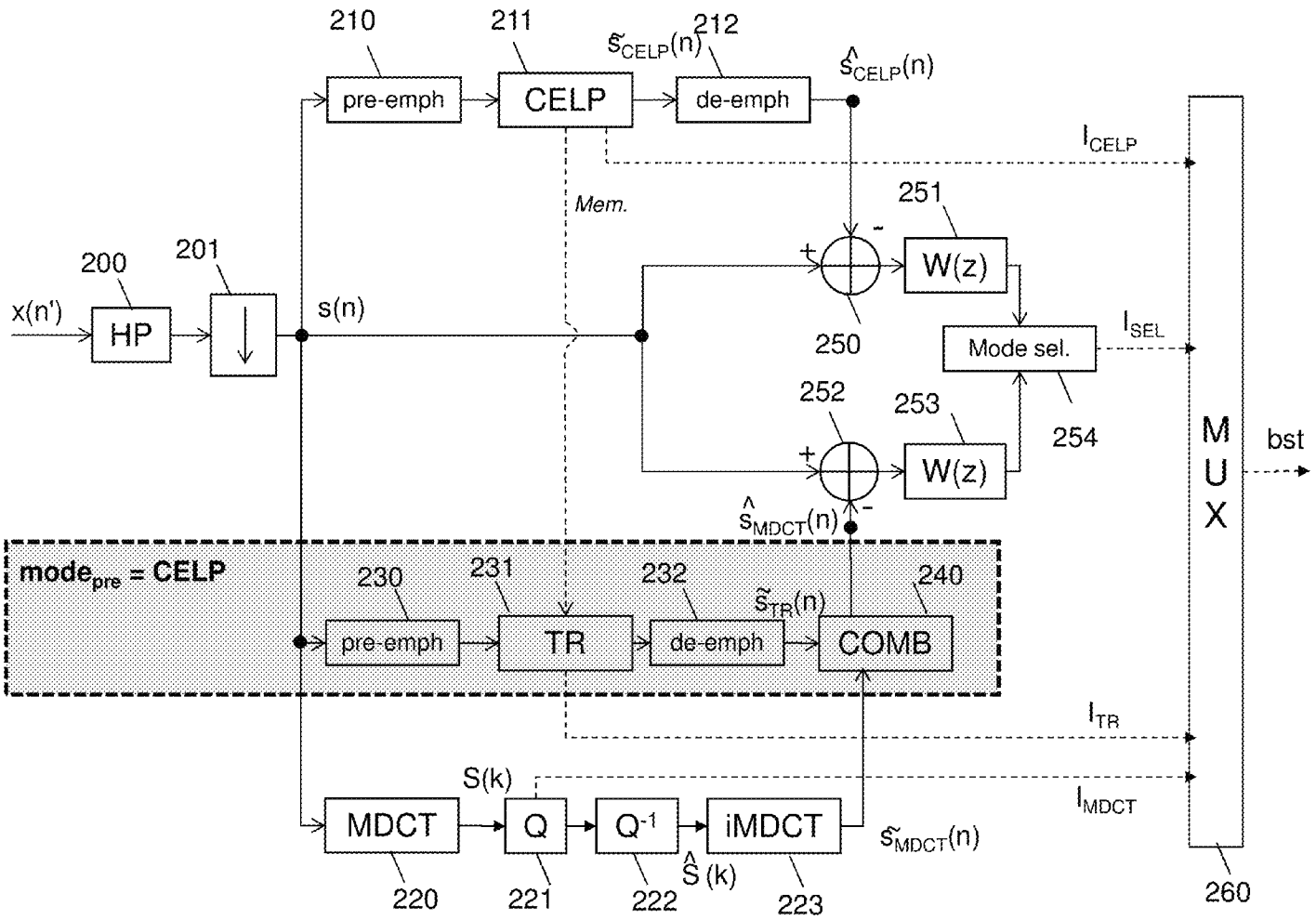
FIG. 2 illustrates, in the form of a block diagram, an encoder and a coding method according to one embodiment of the invention.

FIG. 2 represents a multimode CELP/MDCT encoder in which the coding method according to the invention is applied.

This figure represents the coding steps carried out for each signal frame. The input signal, marked x(n'), is sampled at 16 kHz and the frame length is 20 ms. The invention applies generally to the cases in which other sampling frequencies are used, for example for super-wideband signals sampled at 32 kHz, with optionally a division into two sub-bands in order to apply the invention in the low band. The frame length is in this instance chosen to correspond to that of the mobile encoders such as 3GPP AMR and AMR-WB, but other lengths are also possible (for example: 10 ms).

By convention, the samples of the current frame correspond to x(n'), n'=0, . . . , 319. This input signal is first of all filtered by a high-pass filter (block 200), in order to attenuate the frequencies below 50 Hz and eliminate the continuous component, then sub-sampled at the internal frequency of 12.8 kHz (block 201) in order to obtain a frame of the signal s(n) of 256 samples. It is considered that the decimation filter (block 201) is produced at low delay by means of a finite impulse response filter (typically of the order of 60).

In the CELP coding mode, the current frame s(n) of 256 samples is coded according to the preferred embodiment of the invention by a CELP encoder inspired by the multirate ACELP coding (from 6.6 to 23.05 kbit/s) at 12.8 kHz described in the 3GPP standard TS 26.190 or as an equivalent ITU-T G.722.2—this algorithm is called AMR-WB (for "Adaptive MultiRate—WideBand").

The signal s(n) is first preaccentuated (block 210) by $1-\alpha z^{-1}$ where $\alpha=0.68$, then coded (block 211) by the ACELP algorithm (as described in section 5 of 3GPP standard TS 26.190).

The successive frames of 20 ms contain 256 time samples at 12.8 kHz. The CELP coding uses a memory (or buffer) buf (n), n=−64, . . . , 319, of 30 ms of signal: 5 ms of lookback signal, 20 ms of current frame and 5 ms of lookahead signal.

The signal obtained after preaccentuation of s(n) is copied into this buffer in positions n=64, . . . , 319 so that the current frame corresponding to the positions n=0, . . . , 255 includes 5 ms of lookback signal (n=0, . . . , 63) and 15 ms of "new" signal to be coded (n=64, . . . , 255)—it is in the definition of the buffer that the CELP coding applied here differs from the ACELP coding of the AMR-WB standard because the "lookahead" is in this instance exactly 5 ms without compensation for the sub-sampling filter delay (block 201).

Based on this buffer, the CELP coding (block 211) comprises several steps applied in a manner similar to the ACELP coding of the AMR-WB standard; the main steps are given here as an exemplary embodiment:

a) LPC analysis: An asymmetric window of 30 ms weights the buffer buf (n), and then an autocorrelation is calculated. The linear prediction coefficients (for an order 16) are then calculated via the Levinson-Durbin algorithm. This gives the LPC linear prediction filter A(z).

A conversion of the LPC coefficients into ISP ("Immittance spectral pairs") spectral coefficients is carried out and a quantization (which gives the quantized filter $\hat{A}(z)$).

Finally, an LPC filter for each subframe is calculated by interpolation per subframe between the filter of the current frame and the filter of the preceding frame. In this interpolation step, it is assumed here that the lookback frame has been coded by the CELP mode; in the contrary case, it is assumed that the states of the CELP encoder have been updated.

b) Perceptual weighting of the signal: the preaccentuated signal is then weighted by the filter defined by $W(z)=A(z/\gamma)/(1-\alpha z^{-1})$ where $\alpha=0.68$ and $\gamma=0.92$.

c) Calculation of the pitch in open loop by searching for the maximum of the autocorrelation function of the weighted signal (optionally sub-sampled to reduce the complexity).

d) Search for the "adaptive excitation" in closed loop by analysis by synthesis amongst the values in the vicinity of the pitch obtained in open loop for each of the subframes of the current frame. A low-pass filtering of the adaptive excitation may or may not also be carried out. A bit is therefore produced to indicate whether or not the filter is to be applied. This search gives the component marked v(n). The pitch and the bit associated with the pitch filter are coded in the bit stream.

e) Search for the fixed excitation or innovation marked c(n), in closed loop also by analysis by synthesis. This excitation consists of zeros and signed impulses; the positions and signs of these impulses are coded in the bit stream.

f) The gains of the adaptive excitation and of the algebraic excitation, $\hat{g}_p$, $\hat{g}_c$ respectively, are coded jointly in the bit stream.

In this exemplary embodiment, the CELP encoder divides each frame of 20 ms into 4 subframes of 5 ms and the quantized LPC filter corresponds to the last (fourth) subframe.

The reconstructed signal $\hat{s}_{CELP}(n)$ is obtained by the local decoder included in the block 211, by reconstruction of the excitation $u(n)=\hat{g}_p v(n)+\hat{g}_c c(n)$, optionally postprocessing of u(n), and filtering by the quantized synthesis filter $1/\hat{A}(z)$ (as described in section 5.10 of 3GPP standard TS 26.190). This signal is finally deaccentuated (block 212) by the transfer function filter $1/(1-\alpha z^{-1})$ to obtain the CELP decoded signal $\hat{s}_{CELP}(n)$.

Naturally, other variants of the CELP coding than the embodiment described above can be used without affecting the nature of the invention.

In one variant, the block 211 corresponds to the CELP coding at 8 kbit/s described in ITU-T standard G.718 according to one of the four possible CELP coding modes: nonvoicing mode (UC), voicing mode (VC), transition mode (TC) or generic mode (GC). In another variant, another embodiment of CELP coding is chosen, for example ACELP coding in a mode that can be interworked with the AMR-WB coding of the ITU-T standard G.718. The representation of the LPC coefficients in the form of ISF can be replaced by the pairs of spectral lines (LSF) or other equivalent representations.

In the event of selection of the CELP mode, the block 211 delivers the CELP indices coded $I_{CELP}$ to be multiplexed in the bit stream.

In the MDCT coding mode of FIG. 2, the current frame, s(n), n=0, . . . , 255 is first transformed (block 220) according to a preferred embodiment in order to obtain the following transform coefficients:

$$S(k)\sqrt{\frac{2}{M}}\sum_{n=Mz}^{2M-M_z-1} w(n).s(n-M_z).\cos\left(\frac{\pi}{M}\left(n+\frac{M}{2}+\frac{1}{2}\right)\left(k+\frac{1}{2}\right)\right),$$
$$k=0,\ldots,M-1$$

where M=256 is the frame length and Mz=96 is the number of zeros to the left and right in the window w(n). The window w(n) is chosen in the preferred embodiment as a symmetrical "low delay" window in the form:

$$w_{shift}(m)=\begin{cases} 0 & 0\le m<\frac{M}{2}-\frac{L_{ov}}{2} \\ \sin\left(\pi\frac{m-\left(\frac{M}{2}-\frac{L_{ov}}{2}\right)+\frac{1}{2}}{2L_{ov}}\right) & \frac{M}{2}-\frac{L_{ov}}{2}\le m<\frac{M}{2}+\frac{L_{ov}}{2} \\ 1 & \frac{M}{2}+\frac{L_{ov}}{2}\le m<3\frac{M}{2}-\frac{L_{ov}}{2} \\ \sin\left(\pi\frac{\left(m-3\frac{M}{2}+3\frac{L_{ov}}{2}\right)+\frac{1}{2}}{2L_{ov}}\right) & 3\frac{M}{2}-\frac{L_{ov}}{2}\le m<3\frac{M}{2}+\frac{L_{ov}}{2} \\ 0 & 3\frac{M}{2}+\frac{L_{ov}}{2}\le m<2M \end{cases}$$

This low-delay window $w_{shift}(m)$, m=0, . . . , 511, for M=256 and $L_{ov}$=64, applies to the current frame corresponding to the indices n=0, . . . , 255 by taking $w(n)=w_{shift}(n+96)$, which assumes an overlap of 64 samples (5 ms).

Figure 3A:
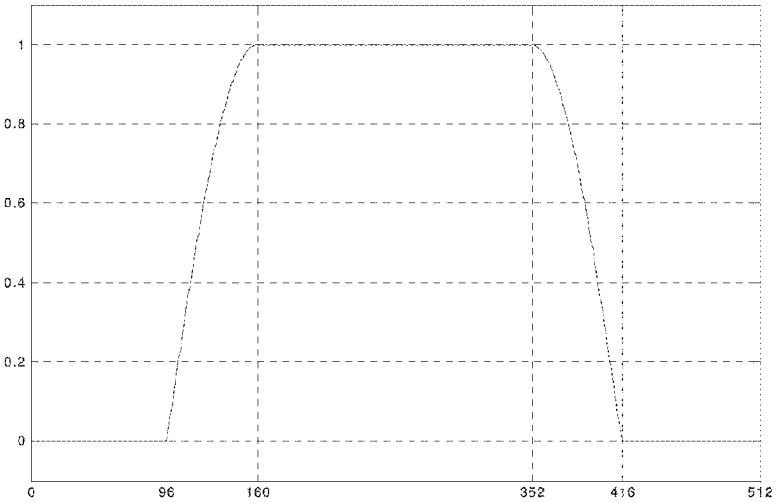
FIG. 3*a* illustrates an example of a weighting window used for the transform coding of the invention.
Figure 3B:
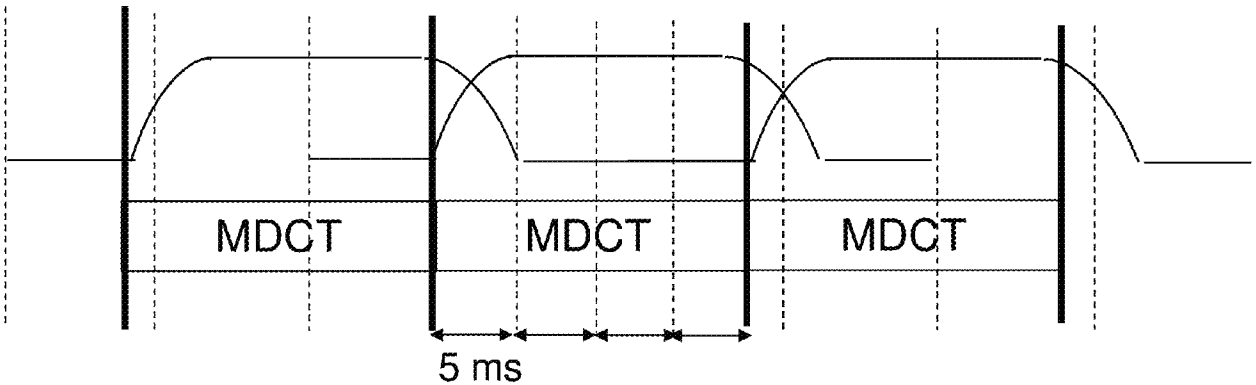
FIG. 3*b* illustrates the overlap transform coding mode used by the invention.

This window is illustrated in FIG. 3*a*. Note that the window has 2(M−Mz)=320 nonzero samples, or 25 ms at 12.8 kHz. FIG. 3*b* illustrates how the window w(n) is applied to each time frame of 20 ms by taking w(n) $w_{shift}(n+96)$.

This window applies to the current frame of 20 ms and to a lookahead signal of 5 ms. Note that the MDCT coding is therefore synchronized with the CELP coding the extent that the MDCT decoder can reconstruct by addition-overlap the whole of the current frame, by virtue of the overlap to the left and on the intermediate "flat" of the MDCT window, and it also has an overlap on the lookahead frame of 5 ms. Note here, for this window, that the current MDCT frame induces a time-domain aliasing on the first part of the frame (in fact on the first 5 ms) where the overlap takes place.

It is important to note that the frames reconstructed by the CELP and MDCT encoders/decoders have coincident temporal supports. This time-domain synchronization of the reconstructions makes the switching of coding models easier.

In variants of the invention, other MDCT windows than w(n) are also possible. The implementation of the block 220 is not given in detail here. An example is given in ITU-T standard G.718 (clauses 6.11.2 and 7.10.6).

The coefficients S(k), k=0, . . . , 255 are coded by the block 221 which is inspired, in a preferred embodiment, by the "TDAC" (for "Time Domain Aliasing Cancellation") coding of the ITU-T standard G.729.1. $B_{tot}$ here marks the total bit budget allocated in each frame to the MDCT coding. The discrete spectrum S(k) is divided into sub-bands, then a spectral envelope, corresponding to the r.m.s (for "root mean square", that is to say the root mean square of the energy) per sub-band, is quantized in the logarithmic domain in steps of 3 dB and coded by entropic coding. The bit budget used by this envelope coding is marked here $B_{env}$; it is variable because of the entropic coding.

Unlike the "TDAC" coding of the G.729.1 standard, a predetermined number of bits marked $B_{inj}$ (a function of the budget $B_{tot}$) is reserved for the coding of noise injection levels in order to "fill" the coefficients coded at a zero value by noise and mask the artifacts of "musical noise" which would otherwise be audible. Then, the sub-bands of the spectrum S(k) are coded by spherical vectorial quantization with the remaining budget of $B_{tot}-B_{env}-B_{inj}$ bits. This quantization is not given in detail, just like the adaptive allocation of the bits per sub-band, because these details extend beyond the context of the invention. In the event of selection of the MDCT mode or of the transition mode, the block 221 delivers the MDCT indices coded $I_{MDCT}$ to be multiplexed in the bit stream.

The block 222 decodes the bit stream produced by the block 221 in order to reconstruct the decoded spectrum $\hat{S}(k)$, k=0, . . . , 255. Finally, the block 223 reconstructs the current frame in order to find the signal $\tilde{s}_{MDCT}(n)$, n=0, . . . , 255.

Because of the nature of the MDCT transform coding (overlap between the frames), two situations are to be envisioned in the MDCT coding of a current frame:

First case: The preceding frame has been coded by an MDCT mode. In this case, the memory (or states) necessary to the MDCT synthesis in the local (and remote) decoder is available and the addition/overlap operation used by the MDCT to cancel out the time-domain aliasing is possible. The MDCT frame is correctly decoded over the whole frame. This involves the "normal" operation of MDCT coding/decoding.

Second case: The preceding frame has been coded by a CELP mode. In this case, the reconstruction of the frame at the (local and remote) decoder is not complete. As explained above, the MDCT uses for the reconstruction an addition/overlap operation between the current frame and the preceding frame (with states stored in memory) in order to remove the time-domain aliasing of the frame to be decoded and also prevent the effects of blocks and increase the frequency resolution by the use of windows longer than a frame. With the MDCT windows most widely used (the sinusoidal type), the distortion of the signal due to the time-domain aliasing is greater at the end of the window and virtually zero in the middle of the window. In this precise case, if the preceding frame is of CELP type, the MDCT memory is not available because the last frame has not been MDCT-transform-coded.

The aliased zone at the beginning of the frame corresponds to the zone of the signal in the MDCT frame which is disrupted by the time-domain aliasing inherent in the MDCT transformation.

Thus, when the current frame is coded by the MDCT mode (blocks 220 to 223) and the preceding frame has been coded by the CELP mode (blocks 210 to 212), a specific treatment of transition from CELP to MDCT is necessary.

Figure 4A:
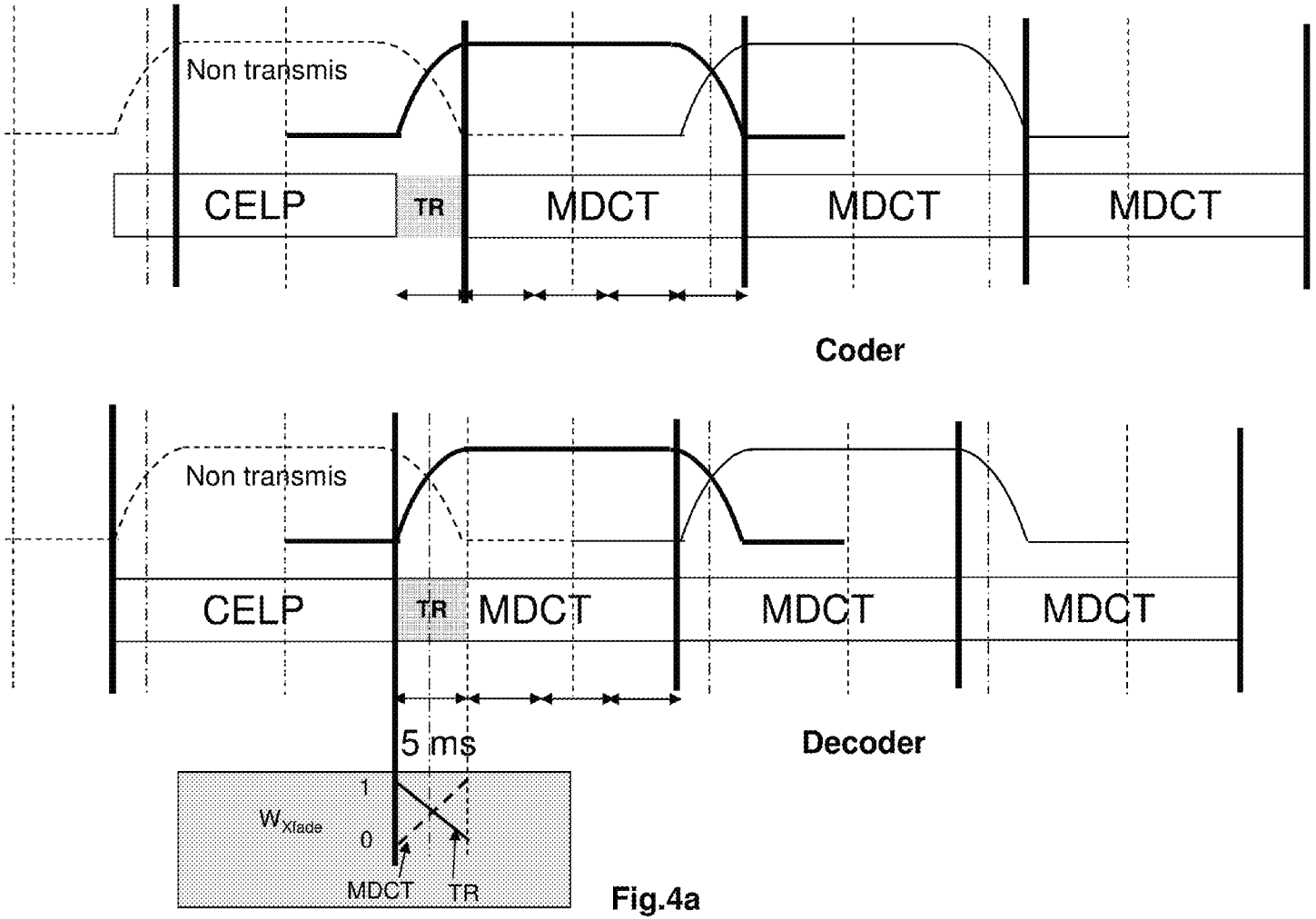
FIG. 4*a* illustrates the transition between a frame coded with predictive coding and a transform-coded frame according to one embodiment of the method of the invention.

In this case, as indicated in FIG. 4*a*, the first frame is coded by the CELP mode and can be wholly reconstructed by the (local or remote) CELP decoder. On the other hand, the second frame is coded by the MDCT mode; it is considered that this second frame is the current frame. The overlap zone to the left of the MDCT window poses a problem because the complementary part (with time-domain aliasing) of this window is not available since the preceding frame has not been coded by MDCT. The aliasing in this left part of the MDCT window can therefore not be removed.

For this transition, the coding method according to the invention comprises a step of coding a block of samples that is shorter or equal in length to the length of the frame, chosen for example as an additional subframe of 5 ms, in the current transform-coded (MDCT) frame, representing the aliasing zone to the left of the current frame, by a predictive transition encoder or restricted predictive coding. It should be noted that the type of coding in the frame preceding the MDCT transition frame could be a type of coding other than CELP coding, for example MICDA coding or TCX coding. The invention applies in the general case in which the preceding frame has been coded by coding not updating the MDCT memories in the domain of the signal and the invention involves coding a block of samples corresponding to a part of the current frame by transition coding using the coding information of the preceding frame.

The predictive transition coding is restricted relative to the predictive coding of the preceding frame; it involves using the stable parameters of the preceding frame coded by predictive coding and coding only a few minimal parameters for the additional subframe in the current transition frame.

Thus, this restricted predictive coding reuses at least one parameter of the predictive coding of the preceding frame and therefore codes only the unreused parameters. In this sense, it is possible to call it restricted coding (by the restriction of the coded parameters).

The embodiments illustrated in FIGS. 4*a* to 4*e* assume that the overlap to the left of the first MDCT window is less than or equal to the length of the subframe (5 ms). In the contrary case, one or more additional CELP subframe(s) must also be coded, adaptive excitation dictionaries and/or fixed ones of a size adapted to the length of overlap must be used.

In FIGS. 4*a* to 4*e*, the mixed line (lines with alternating dots and dashes) correspond to the MDCT coding aliasing lines and to the MDCT decoding anti-aliasing lines. At the top of these figures, the bold lines separate the frames at the entrance of the encoder; it is possible to begin the encoding of a new frame when a frame thus defined is fully available. It is important to note that these bold lines at the encoder do not correspond to the current frame but to the block of new samples arriving for each frame; the current frame is in fact delayed by 5 ms. At the bottom, the bold lines separate the decoded frames at the output of the decoder.

The specific processing of the transition frame corresponds to the blocks 230 to 232 and to the block 240 of FIG. 2. This processing is carried out when the preceding mode, marked $mode_{pre}$, that is to say the type of coding of the preceding frame (CELP or MDCT), is of CELP type.

The coding of the current transition frame between CELP and MDCT coding (the second frame in FIGS. 4*a* to 4*e*) is based on several steps implemented by the block 231:

MDCT coding of the frame: in the exemplary embodiment illustrated at the top of FIG. 4*a*, the window chosen for this coding is the window w(n) defined above, with an effective length of 25 ms. Other forms of windows to replace w(n) in the MDCT transition frame (the first MDCT frame following a CELP frame) are illustrated in FIGS. 4*b*, 4*c*, 4*d* and 4*e* with one and the same effective length which may be different from 25 ms. For the case of FIG. 4*a*, the 20 ms of the current frame are placed at the beginning of the nonzero portion of the window, while the remaining 5 ms are the first 5 milliseconds of the lookahead frame. After the calculation of the MDCT (by aliasing and discrete cosine transform (DCT)), the 256 samples of the MDCT spectrum are therefore obtained. The quantization of these coefficients is in this instance carried out by transmission of the spectral envelope and spherical vectorial quantization for each standardized sub-band of the envelope. The difference from the preceding description of the "normal" MDCT coding is that the budget allocated to the vectorial quantization in the transition frame is no longer $B_{tot}-B_{env}-B_{inj}$ but $B_{tot}-B_{env}-B_{inj}-B_{trans}$, $B_{trans}$ representing the number of bits necessary for the transmission of the missing information to generate the input excitation of the filter $1/\hat{A}(z)$ in the transition encoder. This number of bits, $B_{trans}$, is variable as a function of the total bit rate of the encoder.

Decoding of the quantized spectrum (at the bottom in FIGS. 4*a* to 4*e*): after reconstruction of the quantized spectrum and the partial inverse MDCT transformation operation (by anti-aliasing and multiplication by the synthesis window but without addition-overlap because the MDCT memories are not available from the preceding frame), the time-domain signal is obtained in which the first 5 milliseconds (the first subframe) contain the time-domain aliasing, then 15 ms of the reconstructed signal, the last 5 milliseconds finally serving to feed the MDCT memory necessary for the reconstruction of the next frame, if the latter is of the MDCT type; if the next frame is of the CELP type, this memory is usually of no use.

Coding of the first subframe (the grayed zone marked "TR" in FIGS. 4*a* to 4*e*) by transition coding comprising restricted predictive coding.

This restricted predictive coding comprises the following steps.

The filter $\hat{A}(z)$ of the first subframe is for example obtained by copying the filter $\hat{A}(z)$ of the fourth subframe of the preceding frame. This saves having to calculate this filter and saves the number of bits associated with its coding in the bit stream.

This choice is justified because, in a codec alternating between CELP and MDCT, the MDCT mode is usually selected in the virtually stationary segments in which the coding in the frequency domain is more efficient than in the time domain. At the moment of switching between the ACELP and MDCT modes, this stationarity is normally already established; it is possible to assume that certain parameters such as the spectral envelope change very little from frame to frame. Thus the quantized synthesis filter $1/\hat{A}(z)$ transmitted during the preceding frame, representing the spectral envelope of the signal, can be reused effectively.

The pitch (making it possible to reconstruct the adaptive excitation by use of the lookback excitation) is calculated in closed loop for this first transition subframe. The latter is coded in the bit stream, optionally in a differential manner relative to the pitch of the last CELP subframe. The adaptive excitation v(n) (n=0, . . . , 63) is deduced therefrom. In a variant, the pitch value of the last CELP frame may also be reused without transmitting it.

One bit is allocated to indicate whether the adaptive excitation v(n) has or has not been filtered by a low-pass filter of coefficients (0.18, 0.64, 0.18). However, the value of this bit could be taken from the last preceding CELP frame.

The search for the algebraic excitation of the subframe is carried out in closed loop only for this transition subframe and the coding of the positions and signs of the excitation pulses are coded in the bit stream, here again with a number of bits that depends on the bit rate of the encoder.

The gains $\hat{g}_p, \hat{g}_c$ respectively associated with the adaptive and algebraic excitation are coded in the bit stream. The number of bits allocated to this coding depends on the bit rate of the encoder.

As an example, for a total bit rate of 12.65 kbit/s, 9 bits are reserved for the absolute coding of the pitch of the subframe, 6 bits are reserved for the coding of the gain, 52 bits are reserved for the coding of the fixed excitation, and 1 bit indicates whether the adaptive excitation has been filtered or not. Therefore $B_{tr}$=68 bits (3.4 kbit/s) is reserved for the coding of this transition subframe; so there remain 9.25 kbit/s for the MDCT coding in the transition frame.

Once all the parameters have been obtained and coded, it is possible to generate the missing subframe by excitation of the filter $1/\hat{A}(z)$ with the excitation obtained. The block 231 also supplies the parameters of the restricted predictive coding, $I_{TR}$, to be multiplexed in the bit stream. It is important to note that the block 231 uses information, marked Mem. in the figure, of the coding (block 211) carried out in the frame preceding the transition frame. For example, the information includes the LPC and pitch parameters of the last subframe.

The signal obtained is then deaccentuated (block 232) by the filter $1/(1-\alpha z^{-1})$ in order to obtain the reconstructed signal $\tilde{s}_{TR}(n)$, n=0, . . . , 63 in the first subframe of the current CELP to MDCT transition frame.

Finally, the remaining task is to combine the reconstructed signals $\tilde{s}_{TR}(n)$, n=0, . . . , 63 and $\tilde{s}_{MDCT}(n)$, n=0, . . . , 255. For this, a linear progressive mixing (cross-fading) between the two signals is carried out and gives the following output signal (block 240). For example, in a first embodiment, this cross-fade is carried out on the first 5 ms in the following manner as illustrated in FIG. 4*a*:

$$\hat{s}_{MDCT}(n) = \begin{cases} \left(1 - \frac{n}{64}\tilde{s}_{TR}(n) + \frac{n}{64}\tilde{s}_{MDCT}(n)\right) & n = 0, \ldots, 63 \\ \tilde{s}_{MDCT}(n) & n = 64, \ldots, 255 \end{cases}$$

It should be noted that the cross-fade between the two signals is in this instance 5 ms, but it may be smaller. On the assumption that the CELP encoder and the MDCT encoder have perfect or virtually perfect reconstruction, it is even possible to dispense with cross-fade; specifically the first 5 milliseconds of the frame are perfectly coded (by restricted CELP), and the subsequent 15 ms are also perfectly coded (by the MDCT encoder). The attenuation of the artifacts by the cross-fade is theoretically no longer necessary. In this case, the signal $\hat{s}_{MDCT}(n)$ is written more simply:

$$\hat{s}_{MDCT}(n) = \tilde{s}_{TR}(n) \quad n=0, \ldots, 63$$

$$\tilde{s}_{MDCT}(n) \quad n=64, \ldots, 255$$

Figure 4B:
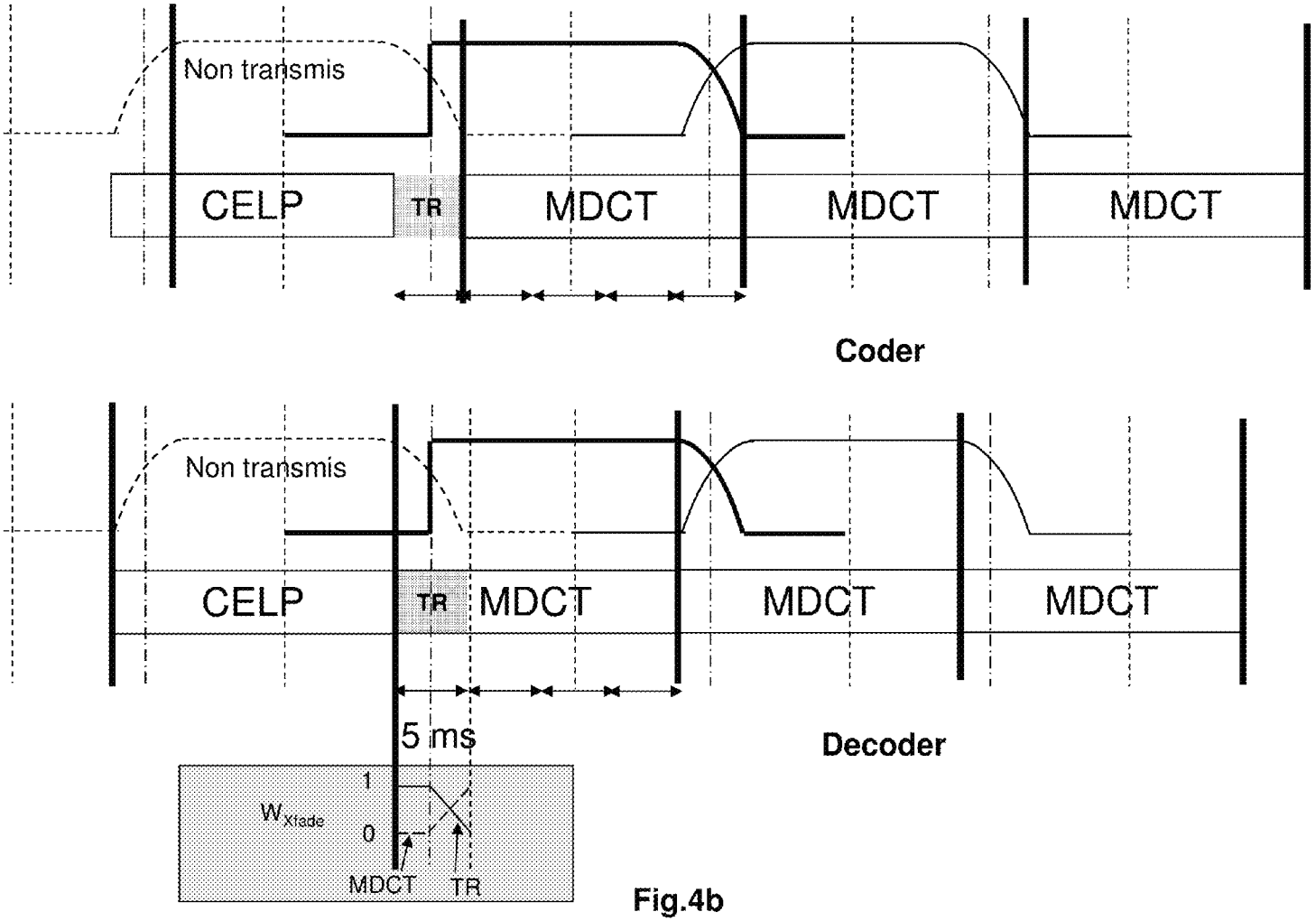
FIGS. 4*b*, 4*c* and 4*d* illustrate the transition between a frame coded with predictive coding and a transform-coded frame according to two variant embodiments of the method of the invention.

In the variant of FIG. 4*b*, the window is replaced by a window identical to the analysis and to the synthesis with a rectangular shape with no aliasing to the left $$w(n) = \begin{cases} 0 & n = 0, \ldots, 31 \\ 1 & n = 32, \ldots, 255 \end{cases}$$

No specification is made here for n<0 and n>255. For n<0 the value of w(n) is zero and for n>255 the windows are determined by the MDCT analysis and synthesis windows used for "normal" MDCT coding.

The cross-fade in FIG. 4*b* is carried out in the following manner:

$$\hat{s}_{MDCT}(n) = \begin{cases} \tilde{s}_{TR}(n) & n = 0, \ldots, 31 \\ \left(1 - \frac{n-32}{32}\right)\tilde{s}_{TR}(n) + \frac{n-32}{32}\tilde{s}_{MDCT}(n) & n = 32, \ldots, 63 \\ \tilde{s}_{MDCT}(n) & n = 64, \ldots, 255 \end{cases}$$

Figure 4C:
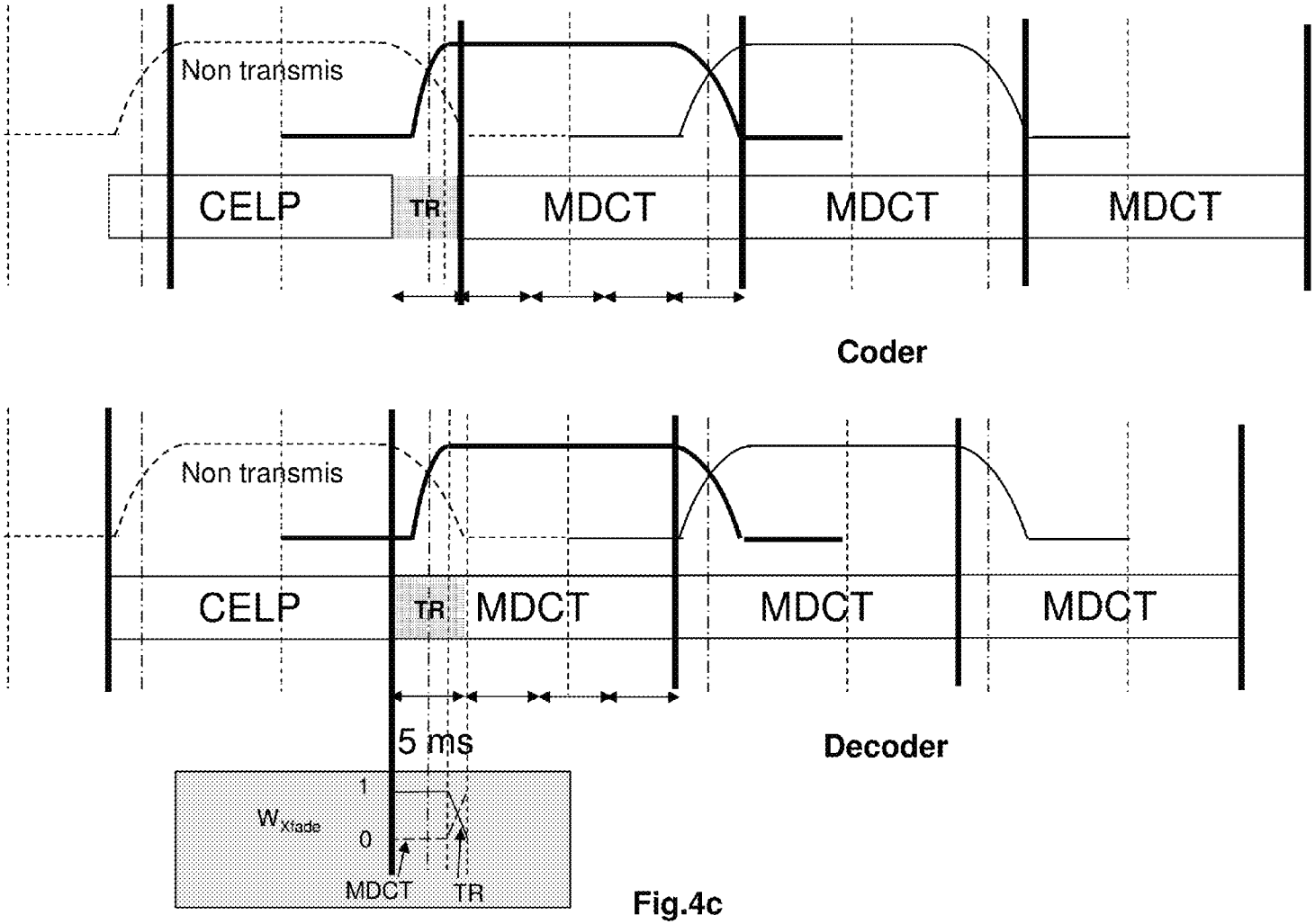

In the variant of FIG. 4*c*, the window is replaced by a window identical to the analysis and to the synthesis with a form including a first part of zero value over 1.25 ms, then a sinusoidal rising edge over 2.5 ms, and a flat of unitary value over 1.25 ms:

$$w(n) = \begin{cases} 0 & n = 0, \ldots, 15 \\ \sin\left(\frac{n-15.5}{32}\pi\right) & n = 16, \ldots, 47 \\ 1 & n = 48, \ldots, 255 \end{cases}$$

No specification is made here for n<0 and n>255. For n<0 the value of w(n) is zero and for n>255 the windows are determined by the MDCT analysis and synthesis windows used for "normal" MDCT coding.

The cross-fade in FIG. 4*c* is carried out in the following manner:

$$\hat{s}_{MDCT}(n) = \begin{cases} \tilde{s}_{TR}(n) & n = 0, \ldots, 37 \\ \left(1 - \frac{n-48}{16}\right)\tilde{s}_{TR}(n) + \frac{n-48}{16}\tilde{s}_{MDCT}(n) & n = 448, \ldots, 63 \\ \tilde{s}_{MDCT}(n) & n = 64, \ldots, 255 \end{cases}$$

which shows that the zone in which the cross-fade is carried out is exempt from time-domain aliasing.

Figure 4D:
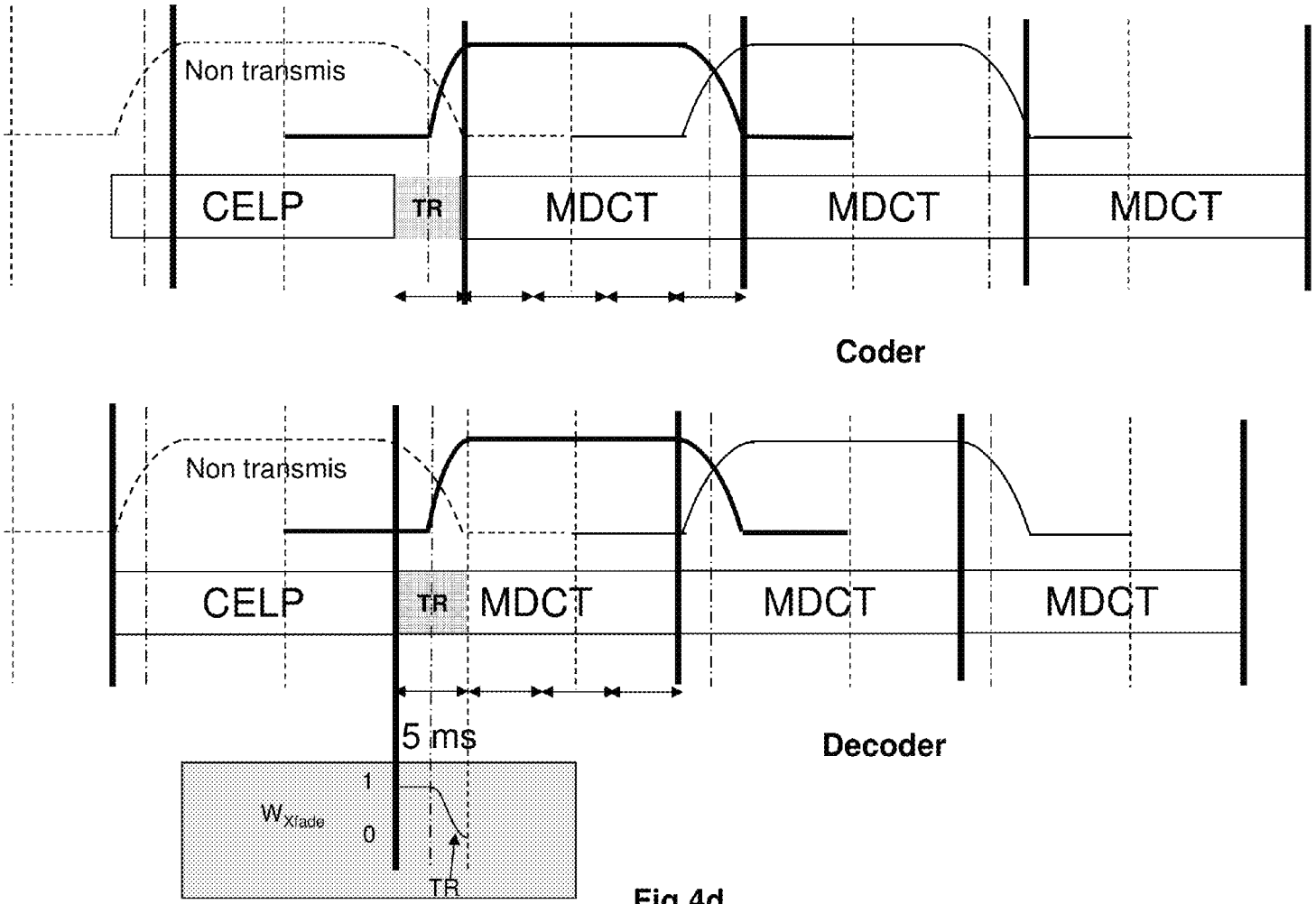
Figure 4E:
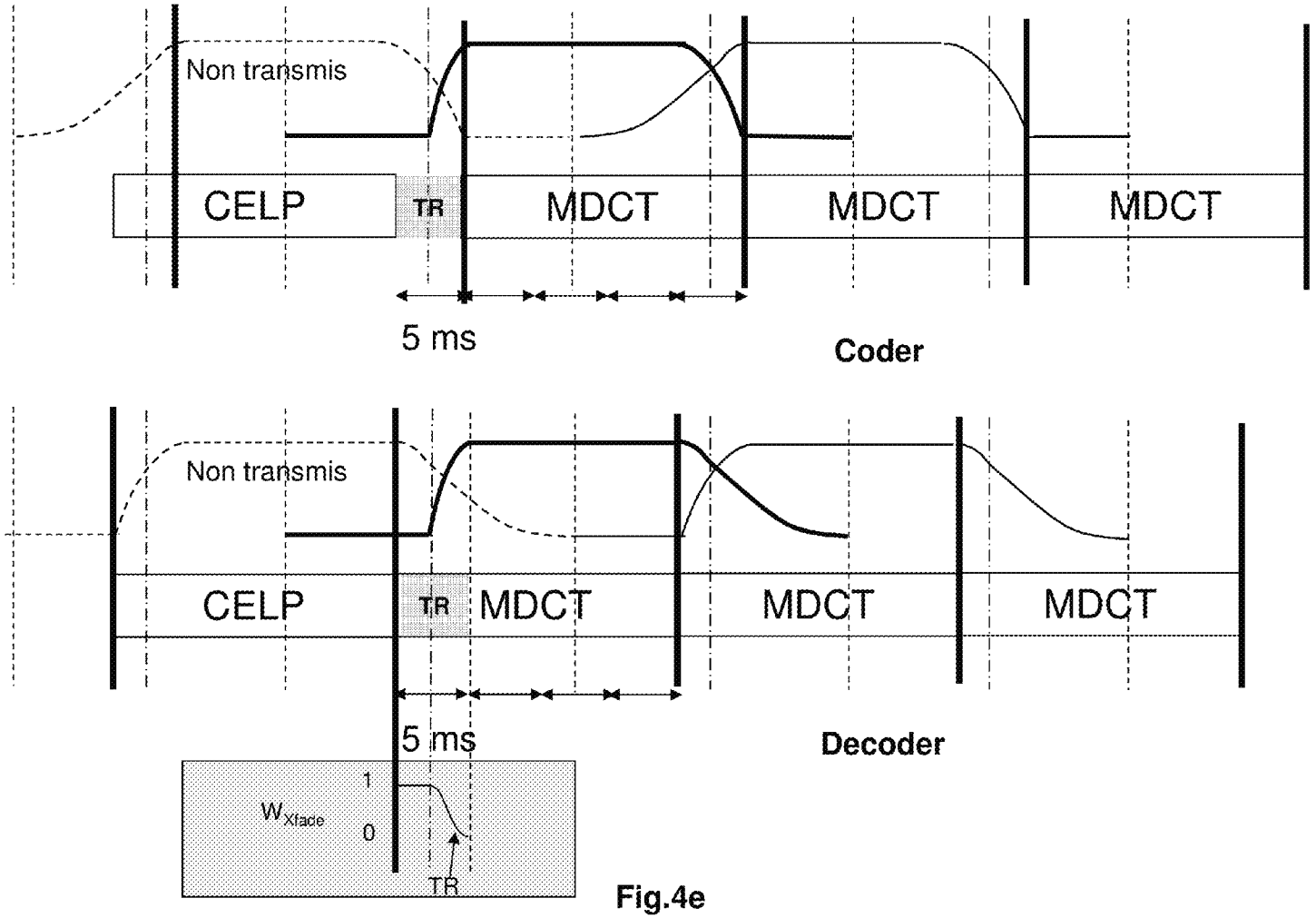
FIG. 4*e* illustrates the transition between a frame coded with predictive coding and a transform-coded frame according to one of the variant embodiments of the method of the invention for the case in which the MDCT transformation uses asymmetric windows.

In the variant of FIGS. 4*d* and 4*e*, it is assumed that the analysis and synthesis MDCT weighting window in the current transition frame (n=0, . . . , 255) is given by:

$$w(n) = \begin{cases} 0 & n = 0, \ldots, 31 \\ \sin\left(\frac{n-31.5}{64}\pi\right) & n = 32, \ldots, 63 \\ 1 & n = 64, \ldots, 255 \end{cases}$$

Note here that no specification is made for n<0 and n>255. For n<0 the value of w(n) is zero and for n>255 the windows are determined by the MDCT analysis and synthesis windows used for "normal" MDCT coding.

The cross-fade is carried out in the following manner, assuming that:

$$\hat{s}_{MDCT}(n) = \begin{cases} \tilde{s}_{TR}(n) & n = 0, \ldots, 31 \\ \cos^2\left(\frac{n-31.5}{64}\pi\right)\tilde{s}_{TR}(n) + \tilde{s}_{MDCT}(n) & n = 32, \ldots, 63 \\ \tilde{s}_{MDCT}(n) & n = 64, \ldots, 255 \end{cases}$$

Note that the cross-fade of FIGS. 4*b* to 4*d* could be used in the configuration of FIG. 4*a* also. The advantage of proceeding in this way is that the cross-fade is carried out on the MDCT decoded part where the error due to the aliasing is the least significant. The structure represented in FIG. 4*a* comes closer to the perfect reconstruction.

It is considered in the exemplary embodiment that the encoder operates with a mode decision in closed loop.

Based on the original signal at 12.8 kHz, s(n), n=0, . . . , 255, and signals reconstructed by each of the two modes, CELP and MDCT, $\hat{s}_{CELP}(n)$ and $\hat{s}_{MDCT}(n)$, n=0, . . . , 255, the mode decision for the current frame is taken (block 254) by calculating (blocks 250, 252) the coding errors $s(n)-\hat{s}_{CELP}(n)$ and $s(n)-\hat{s}_{MDCT}(n)$, then by applying by subframes of 64 samples (5 ms) a perceptual weighting by the filter $W(z)=A(z/\gamma)/(1-\alpha z^{-1})$ where $\gamma=0.92$ of which the coefficients are drawn from the states of the CELP coding (block 211), and finally by calculating a signal-to-noise ratio criterion by segmental (with 5 ms of time-domain unity). The operation of the decision in closed loop (block 254) is not described in further detail. The decision of the block 554 is coded ($I_{SEL}$) and multiplexed in the bit stream.

The multiplexer 260 combines the decision coded $I_{SEL}$ and the various bits coming from the coding modules in the bit stream bst as a function of the decision of the module 254. For a CELP frame, the bits $I_{CELP}$ are sent, for a purely MDCT frame the bits $I_{MDCT}$ are sent and for a CELP-to-MDCT transition frame the bits $I_{TR}$ and $I_{MDCT}$ are sent.

It should be noted that the mode decision could also be performed in open loop or specified in a manner external to the encoder, without changing the nature of the invention.

Figure 5:
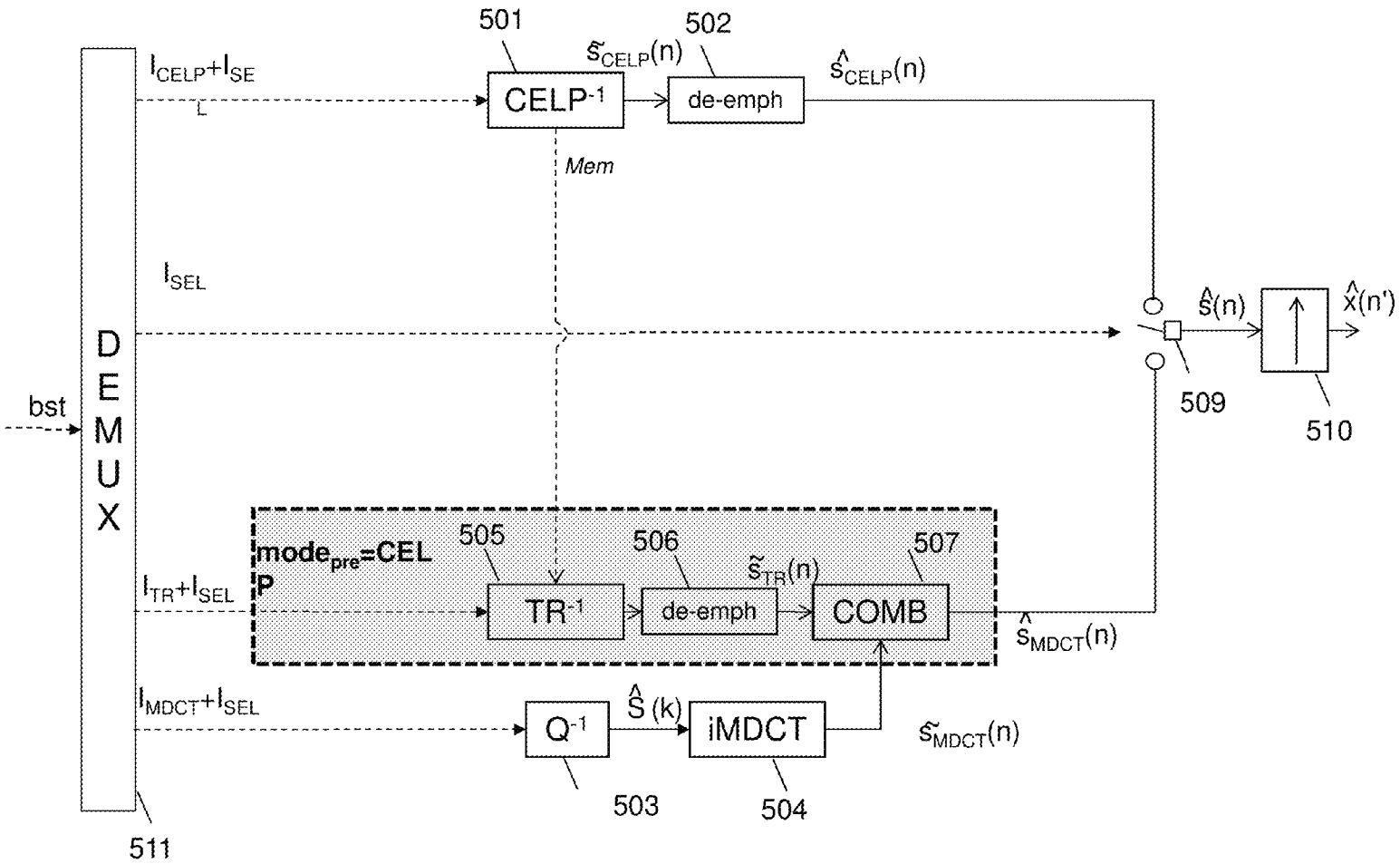
FIG. 5 illustrates a decoder and a decoding method according to one embodiment of the invention.

The decoder according to one embodiment of the invention is illustrated in FIG. 5. The demultiplexer (block 511) receives the bit stream bst and first extracts the mode index $I_{SEL}$. This index controls the operation of the decoding modules and the switch 509. If the index $I_{SEL}$ indicates a CELP frame, the CELP decoder 501 is enabled and decodes the CELP indices $I_{CELP}$. The signal $\tilde{s}_{CELP}(n)$ reconstructed by the CELP decoder 501 by reconstruction of the excitation $u(n)=\hat{g}_p v(n)+\hat{g}_c c(n)$, optionally post-processing of u(n), and filtering the quantized synthesis filter $1/\hat{A}(z)$ is deaccentuated by the filter having the transfer-function $1/(1-\alpha z^{-1})$ (block 502) in order to obtain the CELP decoded signal $\hat{s}_{CELP}(n)$. The switch 509 chooses this signal $\hat{s}_{CELP}(n)$ as the output signal at 12.8 kHz $\hat{s}(n)=\hat{s}_{CELP}(n)$. If the index $I_{SEL}$ indicates a "purely" MDCT frame or a transition frame, the MDCT decoder 503 is enabled; the latter decodes the MDCT indices $I_{MDCT}$. Based on the indices $I_{MDCT}$ transmitted, the block 503 reconstructs the decoded spectrum $\hat{S}(k)$, k=0, . . . , 255, then the block 504 reconstructs the current frame to find the signal $\tilde{s}_{MDCT}(n)$, n=0, . . . , 255. In a transition frame, the indices $I_{TR}$ are also decoded by the module 505. It is important to note that the block 505 uses information, marked Mem. in the figure, of the decoding (block 501) carried out in the frame preceding the transition frame. For example, the information includes the LPC and pitch parameters of the last subframe.

Thus, the decoder reuses at least one parameter of predictive decoding of the preceding frame to decode a first part of the transition frame. It also uses only the parameters received for this first part which correspond to the unreused parameters.

The output of the block 505 is deaccentuated by the filter having the transfer-function $1/(1\alpha\alpha z^{-1})$ (block 506) to obtain the signal reconstructed by the restricted predictive coding $\tilde{s}_{TR}(n)$. This processing (block 505 to 507) is carried out when the preceding mode, marked $mode_{pre}$, that is to say the type of decoding of the preceding frame (CELP or MDCT), is of the CELP type.

In a transition frame, the signals $\tilde{s}_{TR}(n)$ and $\tilde{s}_{MDCT}(n)$ are combined by the block 507; typically a cross-fade operation, as described above for the encoder using the invention, is carried out in the first part of the frame to obtain the signal $\hat{S}_{MDCT}(n)$. In the case of a "purely" MDCT frame, that is to say if the current and preceding frames are coded by MDCT, $\hat{s}_{MDCT}(n)=\tilde{s}_{MDCT}(n)$. The switch 509 chooses this signal $\hat{s}_{MDCT}(n)$ as the output signal at 12.8 kHz $\hat{s}(n)=\hat{s}_{MDCT}(n)$. Then the reconstructed signal $\hat{x}(n)$ at 16 kHz is obtained by oversampling from 12.8 kHz to 16 kHz (block 510). It is considered that this change of rate is carried out with the aid of a finite impulse response filter in polyphase (of order 60).

Thus, according to the coding method of the invention, the samples corresponding to the first subframe of the current frame coded by transform coding are coded by a restricted predictive encoder to the detriment of the bits available to the transform coding (the case of constant bit rate) or by increasing the transmitted bit rate (the case of variable bit rate).

In an embodiment of the invention that is illustrated in FIG. 4*a*, the aliased zone is used only to carry out a cross-fade which provides a soft transition with no discontinuity between the CELP reconstruction and the MDCT reconstruction.

Note that, in a variant, this cross-fade may be carried out on the second part of the aliased zone where the effect of aliasing is less significant. In this variant illustrated in FIG. 4*a* by increasing the bit rate, there is no convergence on the perfect reconstruction because a part of the signal used for the cross-fade is disrupted by the time-domain aliasing.

This variant cannot be transparent even though this low bit rate disruption is completely acceptable and generally virtually inaudible relative to the intrinsic degradation of the low bit rate coding.

In another variant, in the MDCT frame immediately following a CELP frame (a transition frame) (the case illustrated in FIG. 4*b*), it is possible to use an MDCT transformation with no aliasing to the left, with a rectangular window beginning in the middle of the subframe on the aliasing line.

In the framed and grayed part of the figure can be seen the change in the weights of the CELP and MDCT components in the cross-fade. During the first 2.5 ms of the transition frame, the output is identical to the decoded signal of the restricted predictive coding, then the transition is made during the subsequent second 2.5 ms by progressively reducing the weight of the CELP component and increasing the weight of the MDCT component as a function of the exact definition of the MDCT window. The transition is therefore made by using the decoded MDCT signal with no aliasing. Thus it is possible to obtain transparent coding by increasing the bit rate. However, the rectangular windowing may cause block effects in the presence of MDCT coding noise.

FIG. 4*c* illustrates another variant in which the rising part of the window (with time-domain aliasing) to the left is shortened (for example to 2.5 ms) and therefore the first 5 milliseconds of the signal reconstructed by the MDCT mode contain a part (1.25 ms) with no aliasing to the right in this first subframe of 5 ms. Thus the "flat" (that is to say the constant value at 1 with no aliasing) of the MDCT window is extended to the left in the subframe coded by the restricted predictive coding in comparison with the configuration of FIG. 4*a*.

Again, in the framed and grayed part of FIG. 4*c*, it is possible to see the change in the weights of the CELP and MDCT components in the cross-fade for this variant. According to the example given, during the first 3.75 milliseconds, the output is identical to the signal reconstructed by the restricted predictive decoding. For this zone, the MDCT component must not be decoded, because it is not used. Consequently, the shape of the weighting window is of no importance for this zone. The transition is made during the last 1.25 ms by progressively reducing the weight of the CELP component and increasing the weight of the MDCT component. By proceeding in this way, the perfect reconstruction at high bit rate—hence in the absence of quantization error—is ensured because the zone disrupted by the aliasing does not occur in the cross-fade. The cross-fade of these reconstructed signals is carried out on the part of the window in which the reconstructed signal originating from the transform coding of the first part of the current frame comprises no time-domain aliasing. The advantage of this variant relative to that illustrated in FIG. 4*b* is the better spectral property of the window used and the reduction in the block effects, without the rectangular part.

It should be noted that the variant of FIG. 4*b* is an extreme case of the variant of FIG. 4*c* in which the rising part of the window (with time-domain aliasing) to the left is shortened to 0. In another variant of the invention, the length of the rising part of the window (with time-domain aliasing) to the left depends on the bit rate: for example it is shortened with the increase in the bit rate. The weights of the cross-fade used in this case can be adapted to the chosen window.

In FIGS. 4*a*, 4*b* and 4*c*, low-delay MDCT windows have been shown; the latter comprise a chosen number of successive weighting coefficients of zero value at the end and at the beginning of the window. The invention also applies to the case in which the conventional (sinusoidal) MDCT weighting windows are used.

The cross-fade has been shown in the examples given above with linear weights. Evidently other functions of variation of the weights can also be used such as the rising edge of a sinusoidal function for example. In general, the weight of the other component is always chosen so that the total of the 2 weights is always equal to one.

Also note that the weight of the cross-fade of the MDCT component can be incorporated into the MDCT synthesis weighting window of the transition frame for all the variants shown, by multiplying the MDCT synthesis weighting window by the cross-fade weights, which thus reduces the calculation complexity.

In this case, the transition between the restricted predictive coding component and the transform coding component is made by adding first the predictive coding component multiplied by the cross-fade weights and secondly the transform coding component thus obtained, without additional weighting by the weights. Moreover, in the case of the variant shown in FIG. 4*b*, the integration of the cross-fade weights can be carried out in the analysis weighting window. Advantageously it is possible to do this in the variant of FIG. 4*b* because the cross-fade zone is entirely in the part with no aliasing of the frame and the original analysis weighting window had a zero value for the samples preceding the aliasing zone.

This approach is also yet more valuable if the weights of the sinusoidal cross-fade are used because in this way the spectral properties of the analysis weighting window are substantially improved relative to the rectangular window (on the left side) of FIG. 4*b* or relative to a triangular window with linear weights. Yet more advantageously, the same window can be used as an MDCT analysis and synthesis window which reduces the storage. This variant is illustrated in FIG. 4*d*.

It can be seen therein that the rising part of the transition analysis/synthesis weighting window is in the zone with no aliasing (after the aliasing line). This rising part is in this instance defined as a quart of a sinusoidal cycle, such that the combined effect of the analysis/synthesis windows implicitly gives cross-fade weights in the form of a square sine. This rising part serves both for the MDCT windowing and for the cross-fade. The weights of the cross-fade for the restricted predictive coding component are complementary to the rising part of the combined analysis/synthesis weighting windows such that the total of the two weights always gives 1 in the zone in which the cross-fade is carried out. For the example of the MDCT analysis/synthesis windows with a rising part defined as a quarter of a sinusoidal cycle, the weights of the cross-fade for the restricted predictive coding component are therefore in the form of a square cosine (1 minus square sine). Thus, the weights of the cross-fade are incorporated both into the analysis and synthesis weighting window of the transition frame. The variant illustrated in FIG. 4*d* makes it possible to achieve the perfect high bit rate reconstruction because the cross-fade is carried out in a zone with no time-domain aliasing.

The invention also applies to the case in which MDCT windows are asymmetrical and to the case in which the MDCT analysis and synthesis windows are not identical as in the ITU-T standard G.718. Such an example is given in FIG. 4*e*. In this example, the left side of the MDCT transition window (in bold line in the figure) and the weights of the cross-fade are identical to those of FIG. 4*d*. Clearly the window and the cross-fade corresponding to the other embodiments already explained (for example those of FIGS. 4*a* to 4*c*) could equally be used in the left part of the transition window.

It can be seen in FIG. 4*e*, for asymmetrical MDCT windows, that, at the encoder, the right part of the transition analysis window is identical to the right part of the MDCT analysis window normally used and that, at the decoder, the right part of the transition MDCT synthesis window is identical to the right part of the MDCT synthesis window normally used. As for the left side of the transition MDCT weighting window, the left part of one of the MDCT transition windows already shown in FIGS. 4*a* to 4*d* is used (in the example of FIG. 4*e*, that of FIG. 4*d* is used).

The weights of the cross-fade are chosen as a function of the window used, as explained in the variant embodiments of the invention described above (for example in FIGS. 4*a* to 4*d*).

Generalizing, according to the invention, for the MDCT component in the transition frame, the left half of the MDCT analysis weighting window used is chosen such that the right part of the zone corresponding to this half-window comprises no time-domain aliasing (for example according to one of the examples of FIGS. 4*a* to 4*e*) and the left half of the corresponding MDCT synthesis weighting window is chosen such that, after the combined effect of the analysis and synthesis windows, this zone with no aliasing has a weight of 1 at least on the right side (with no attenuation). FIGS. 4*a* to 4*e* show examples of pairs of analysis and synthesis windows which verify these criteria. According to these examples, the left half of the transition MDCT weighting window is identical to the analysis and the synthesis but this is not necessarily the case in all the embodiments of the invention. It should be noted that, for example, the shape of the synthesis window in the zone in which the weight of the MDCT component in the cross-fade is zero is of no importance because these samples will not be used; it must not even be calculated. On the other hand, the contribution of the analysis and synthesis windows in the weights of the cross-fade may also be distributed in an uneven manner which would give different analysis and synthesis windows in the left half of the transition MDCT weighting window. As for the right half of the transition analysis and synthesis windows, they are identical to those of the MDCT weighting windows normally used in the zones coded only by transform coding. In order to ensure a perfect reconstruction in the absence of quantization error (at very high bit rate), the cross-fade between the signal reconstructed by the restricted predictive decoder and the signal reconstructed by the transform decoder must be carried out in a zone with no time-domain aliasing. The combined effect of the analysis and synthesis windows can implicitly integrate the weights of the cross-fade of the component reconstructed by the transform decoder.

In order to limit the impact on the bit rate allocated to the MDCT coding, it is of value to use the fewest possible bits for this restricted predictive coding while ensuring good quality. In a codec alternating CELP and MDCT, the MDCT mode is usually selected in the virtually stationary segments where the coding in the frequency domain is more effective than in the time domain. However, it is possible to also consider cases in which the mode decision is taken in open loop or managed externally to the encoder, with no guarantee that the stationarity assumption is verified.

At the time of the switch between the ACELP and MDCT modes, this stationarity is normally already established; it can be assumed that certain parameters such as the spectral envelope change very little from frame to frame. Thus the quantized synthesis filter 1/A(z) transmitted during the preceding frame, representing the spectral envelope of the signal, can be reused in order to save bits for the MDCT coding. The last synthesis filter transmitted is used in the CELP mode (closest to the signal to be coded).

The information used to code the signal in the transition frame is: the pitch (associated with the long-term excitation), the excitation (or innovation) vector and the gain(s) associated with the excitation.

In another embodiment of the invention, the decoded value of the pitch and/or its gain associated with the last subframe can also be reused because these parameters also change slowly in the stationary zones. This further reduces the quantity of information to be transmitted during a transition from CELP to MDCT.

It is also possible, in a variant embodiment, to quantize these parameters as a differential over a few bits relative to the parameters decoded in the last subframe of the preceding CELP frame. In this case, only the correction that represents the slow change in these parameters is therefore coded.

One of the desired properties of the transition from CELP to MDCT is that, at high asymptotic bit rate, when the CELP and MDCT encoders have virtually perfect reconstruction, the coding carried out in the transition frame (the MDCT frame following a CELP frame) must itself have virtually perfect reconstruction. The variants illustrated in FIGS. 4*b* and 4*c* provide a virtually perfect reconstruction at very high bit rate.

For the purposes of uniformity of quality, the number of bits allocated to these parameters of the restricted predictive coding can be variable and proportional to the total bit rate.

In order to limit the effects of transition from one type of coding to the other, a progressive transition between the part of the signal coded by the predictive coding and the rest of the frame that is transform-coded (cross-fade, fade-in for the transform component, fade-out for the predictive component) is carried out. In order to achieve transparent quality, this cross-fade must be carried out on an MDCT decoded signal with no aliasing.

In addition to the variants of FIGS. 4*b* and 4*c* in an additional variant, in order to ensure the possible transparency at high bit rate, the principle of the MDCT coding is modified such that no time-domain aliasing to the left is used in the MDCT window of the transition frame. This variant involves using a modified version of the DCT transformation in the heart of the MDCT transformation because the length of the aliased signal is different, since the time-domain aliasing (reducing the size of the block) is carried out only to the right.

It should be noted that the invention is described in FIGS. 4*a* to 4*d* for the simplified case of MDCT analysis and synthesis windows that are identical in each frame (except for the transition frame) coded by the MDCT mode. In variants of the invention, the MDCT window can be asymmetrical as illustrated in FIG. 4*e*. Moreover, the MDCT coding can use a switching of windows between at least one "long" window of typically 20-40 ms and a series of short windows of typically 5-10 ms (window switching).

Moreover, other variants are equally defined in the case in which the selection of CELP/MDCT modes is not optimal and the assumption of stationarity of the signal in the transition frame is not verified and the reuse of the parameters of the last CELP frame (LPC, pitch) can cause audible degradations. For such cases, the invention provides for the transmission of at least one bit to indicate a different transition mode of the method described above in order to keep more CELP parameters and/or CELP subframes to be coded in the transition frame from CELP to MDCT. For example, a first bit can signal whether, in the rest of the bit stream, the LPC filter is coded or the last version received can be used at the decoder, and another bit could signal the same thing for the value of the pitch. In the case in which the encoding of a parameter is considered necessary, this can be done as a differential relative to the value transmitted in the last frame.

Figure 6B:
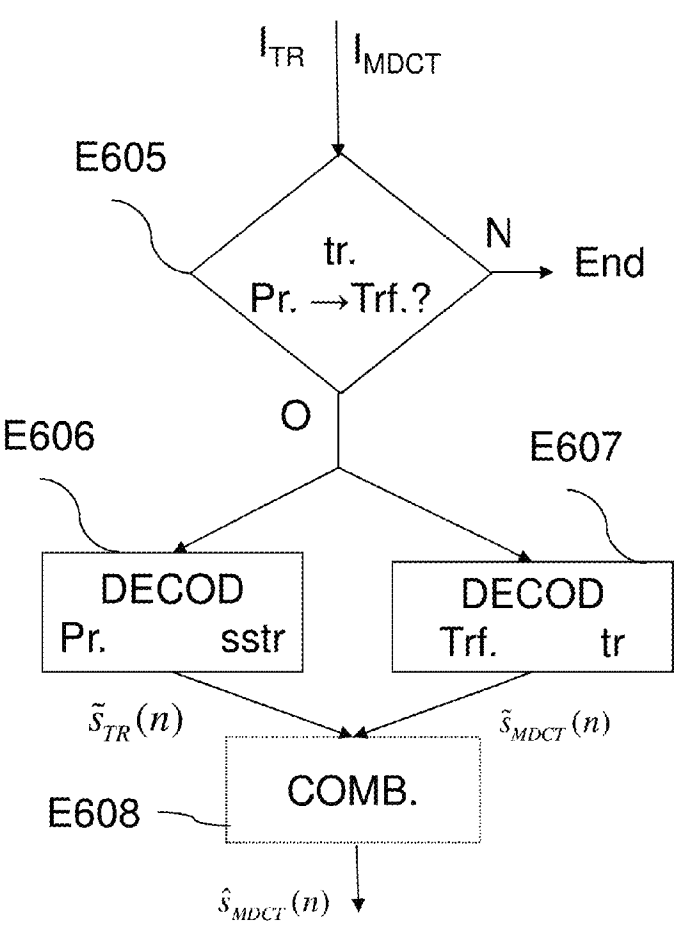
FIGS. 6*a* and 6*b* illustrate in the form of a flowchart the main steps of the coding method, respectively of the decoding method, according to the invention.
Figure 6A:
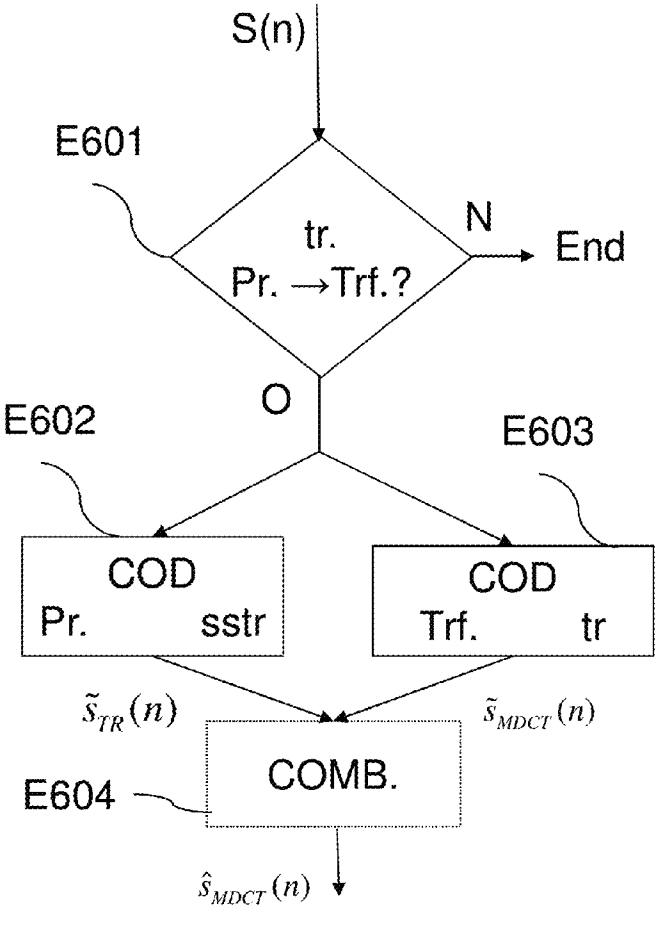

Therefore, in general, in line with the embodiments described above, the coding method according to the invention can be illustrated in the form of a flowchart as shown in FIG. 6*a*.

For the signal to be coded s(n), in step E601 verification is made that it is in the case in which the current frame is to be coded according to transform coding and in which the preceding frame has been coded according to coding of predictive type. Thus, the current frame is a transition frame between predictive coding and transform coding.

In step E602, restricted predictive coding is applied to a first part of the current frame. This predictive coding is restricted relative to the predictive coding used for the preceding frame.

After this restricted predictive coding step, the signal $\tilde{s}_{TR}(n)$ is obtained.

The MDCT coding of the current frame is carried out in step E603, in parallel for all the current frame.

After this transform coding step, the signal $\tilde{s}_{MDCT}(n)$ is obtained.

According to the embodiments described for the invention, the method comprises a step of combining by cross-fade in step E604, after reconstruction of the signals, making it possible to carry out a soft transition between the predictive coding and transform coding in the transition frame. After this step, a reconstructed signal $\hat{s}_{MDCT}(n)$ is obtained.

Similarly, in general, the decoding method according to the invention is illustrated with reference to FIG. 6*b*.

When, during decoding, a preceding frame has been decoded according to a decoding method of the predictive type and when the current frame is to be decoded according to a decoding method of the transform type (verification in E605), the decoding method comprises a step of decoding by restricted predictive decoding of a first part of the current frame, in E606. It also comprises a step of transform decoding in E607 of the current frame.

A step E608 is then carried out, according to the embodiments described above, to carry out a combination of the decoded signals obtained, respectively $\tilde{s}_{TR}(n)$ and $\tilde{s}_{MDCT}(n)$, by cross-fade over all or part of the current frame and thus to obtain the decoded signal $\hat{s}_{MDCT}(n)$ of the current frame.

Finally, the invention has been presented in the specific case of a transition from CELP to MDCT. It is evident that this invention applies equally to the case in which the CELP coding is replaced by another type of coding, such as MICDA, TCX, and in which transition coding over a part of the transition frame is carried out by using the information from the coding of the frame preceding the transition MDCT frame.

Figure 7:
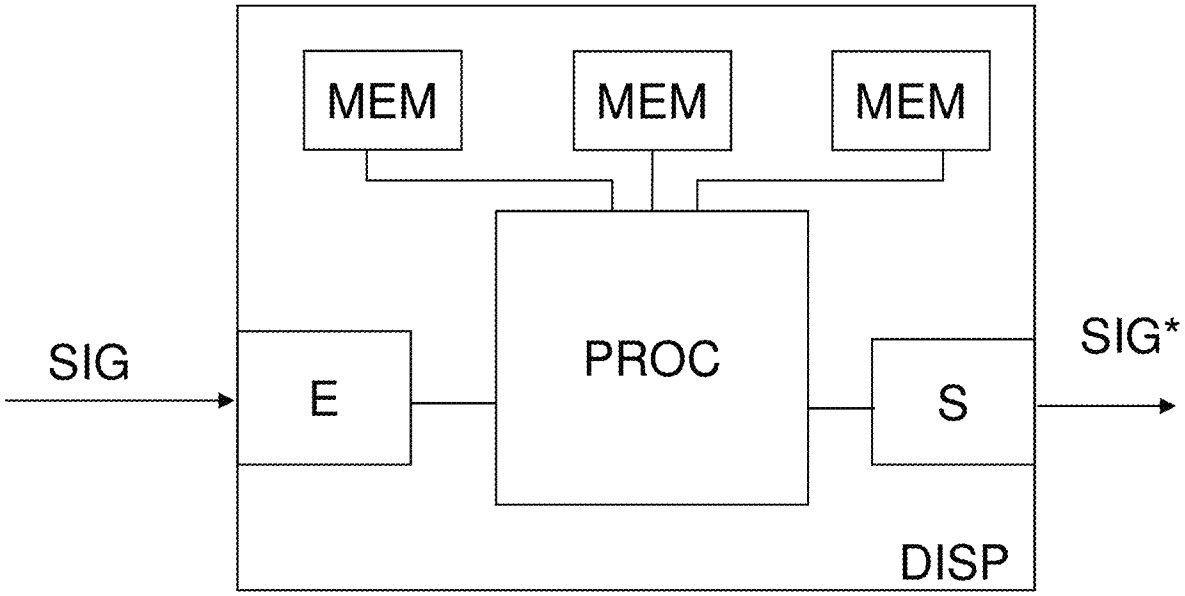
FIG. 7 illustrates one possible hardware embodiment of an encoder and a decoder according to the invention.

FIG. 7 describes a hardware device suitable for producing an encoder or a decoder according to one embodiment of the present invention.

This device DISP comprises an input for receiving a digital signal SIG which, in the case of the encoder, is an input signal x(n') and, in the case of the decoder, the bit stream bst.

The device also comprises a digital-signal processor PROC suitable for carrying out coding/decoding operations notably on a signal originating from the input E.

This processor is connected to one or more memory units MEM suitable for storing information necessary for driving the device for coding/decoding. For example, these memory units comprise instructions for the application of the coding method described above and notably for applying the steps of coding of a preceding frame of samples of the digital signal according to predictive coding, and coding of a current frame of samples of the digital signal according to transform coding, such that a first part of the current frame is coded by predictive coding that is restricted relative to the predictive coding of the preceding frame, when the device is of the encoder type.

When the device is of the decoder type, these memory units comprise instructions for the application of the decoding method described above and notably for applying the steps of predictive decoding of a preceding frame of samples of the digital signal received and coded according to predictive coding, inverse transform decoding of a current frame of samples of the digital signal received and coded according to transform coding, and also a step of decoding by predictive decoding that is restricted relative to the predictive decoding of the preceding frame of a first part of the current frame.

These memory units may also comprise calculation parameters or other information.

More generally, a storage means that can be read by a processor, which may or may not be integrated into the encoder or decoder, optionally removable, stores a computer program applying a coding method and/or a decoding method according to the invention. FIGS. 6*a* and 6*b* can for example illustrate the algorithm of such a computer program.

The processor is also suitable for storing results in these memory units. Finally, the device comprises an output S connected to the processor in order to provide an output signal SIG* which, in the case of the encoder, is a signal in the form of a bit stream bst and, in the case of the decoder, an output signal $\hat{x}(n')$.

The invention claimed is:

1. A method for coding a digital sound signal, said method being performed by a coding entity comprising a processor unit, a transform encoder and a predictive encoder, comprising:

coding a preceding frame of samples of the digital signal according to predictive coding with the predictive encoder;

coding a current frame of samples of the digital signal according to transform coding with the transform encoder; and coding a first part of the current frame with the predictive encoder by predictive coding that is restricted relative to the predictive coding of the preceding frame by reusing at least one parameter of the predictive coding of the preceding frame and by coding only the unreused parameters of this first part of the current frame.

2. The method as claimed in claim 1, wherein the restricted predictive coding uses a prediction filter copied from the preceding frame of predictive coding.

3. The method as claimed in claim 2, wherein the restricted predictive coding also uses a decoded value of pitch and/or of associated gain of the preceding frame of predictive coding.

4. The method as claimed in claim 1, wherein certain parameters of predictive coding used for the restricted predictive coding are quantized in differential mode relative to decoded parameters of the preceding frame of predictive coding.

5. The method as claimed in claim 1, wherein the method comprises a step of obtaining reconstructed signals originating from the predictive and transform local codings and decodings of the first part of the current frame and combining by a cross-fade of these reconstructed signals.

6. The method as claimed in claim 5, wherein said cross-fade of the reconstructed signals is carried out on a portion of the first part of the current frame as a function of the shape of the window of the transform coding.

7. The method as claimed in claim 5, wherein said cross-fade of the reconstructed signals is carried out on a portion of the first part of the current frame, said portion containing no time-domain aliasing.

8. The method as claimed in claim 1, wherein the transform coding uses a weighting window comprising a chosen number of successive weighting coefficients of zero value at the end and beginning of the window.

9. The method as claimed in claim 1, wherein the transform coding uses an asymmetric weighting window comprising a chosen number of successive weighting coefficients of zero value at least one end of the window.

10. A method for decoding a digital sound signal, said method being performed by a decoding entity comprising a processor unit, a transform decoder and a predictive decoder comprising:

predictive decoding a preceding frame of samples of the digital signal received and coded according to predictive coding with the predictive decoder;

inverse transform decoding a current frame of samples of the digital signal received and coded according to transform coding with the transform decoder; and decoding with the predictive decoder by restricted predictive decoding relative to the predictive decoding of the preceding frame of a first part of the current frame received and coded according to restricted predictive coding, by reusing at least one parameter of the predictive decoding of the preceding frame and by decoding only the parameters received for this first part of the current frame.

11. The method as claimed in claim 10, wherein the method comprises a step of combining by a cross-fade of the signals decoded by inverse transform and by restricted predictive decoding for at least one portion of the first part of the current frame.

12. The method as claimed in claim 10, wherein the restricted predictive decoding uses a prediction filter decoded and used by the predictive decoding of the preceding frame.

13. The method as claimed in claim 12, wherein the restricted predictive decoding also uses a decoded value of pitch and/or of associated gain of the predictive decoding of the preceding frame.

14. A digital sound signal encoder, comprising:

a predictive encoder configured to code a preceding frame of samples of the digital signal;

a transform encoder configured to code a current frame of samples of the digital signal; and a predictive encoder that is restricted relative to the predictive coding of the preceding frame in order to code a first part of the current frame, by reusing at least one parameter of the predictive coding of the preceding frame and by coding only the unreused parameters of this first part of the current frame.

15. A digital sound signal decoder, comprising:

a predictive decoder configured to decode a preceding frame of samples of the digital signal received and coded according to predictive coding;

an inverse transform decoder configured to decode a current frame of samples of the digital signal received and coded according to transform coding; and a predictive decoder that is restricted relative to the predictive decoding of the preceding frame in order to decode a first part of the current frame received and coded according to restricted predictive coding, by reusing at least one parameter of the predictive decoding of the preceding frame and by decoding only the parameters received for this first part of the current frame.

16. A hardware storage medium comprising a computer program stored thereon and comprising code instructions for implementing steps of a method of coding or decoding a digital sound signal when these instructions are executed by a processor, the method comprising:

coding or decoding a preceding frame of samples of the digital signal according to predictive coding with the processor;

transform coding or inverse transform decoding a current frame of samples of the digital signal with the processor; and coding or decoding a first part of the current frame with the processor by predictive coding or predictive decoding, respectively, which is restricted relative to the predictive coding of the preceding frame by reusing at least one parameter of the predictive coding or the predictive decoding, respectively, of the preceding frame and by coding or decoding, respectively, only the unreused parameters of this first part of the current frame.

* * * * *